US007892481B2

(12) United States Patent
Yoshihiro et al.

(10) Patent No.: US 7,892,481 B2
(45) Date of Patent: Feb. 22, 2011

(54) MANUFACTURING METHOD FOR WEAR RESISTANT SINTERED MEMBER, SINTERED VALVE SEAT, AND MANUFACTURING METHOD THEREFOR

(75) Inventors: Tatsuaki Yoshihiro, Matsudo (JP); Hideaki Kawata, Matsudo (JP); Hiroki Fujitsuka, Matsudo (JP); Kunio Maki, Matsudo (JP); Toru Tsuboi, Matsudo (JP)

(73) Assignee: Hitachi Powdered Metals Co., Ltd., Matsudo-Shi (JP)

( * ) Notice: Subject to any disclaimer, the term of this patent is extended or adjusted under 35 U.S.C. 154(b) by 160 days.

(21) Appl. No.: 11/546,462

(22) Filed: Oct. 12, 2006

(65) Prior Publication Data

US 2007/0081914 A1 Apr. 12, 2007

(30) Foreign Application Priority Data

Oct. 12, 2005 (JP) ..... 2005-298017
Oct. 24, 2005 (JP) ..... 2005-308778

(51) Int. Cl.
*C22C 32/00* (2006.01)

(52) U.S. Cl. ..... 419/11; 75/231

(58) Field of Classification Search ..... 75/228, 75/230, 236, 243, 245, 246; 419/1, 10–15, 419/17–18, 30, 32–33, 38, 46, 66
See application file for complete search history.

(56) References Cited

U.S. PATENT DOCUMENTS 4,422,875 A 12/1983 Nakata et al.
4,552,590 A 11/1985 Nakata et al.
4,844,738 A 7/1989 Tanase et al.
4,919,719 A 4/1990 Abe et al.
5,068,149 A 11/1991 Shimada et al.
6,082,317 A 7/2000 Takahashi et al.
6,139,599 A * 10/2000 Takahashi et al. ..... 75/246
6,318,327 B1 * 11/2001 Takahashi et al. ..... 123/188.3
6,562,098 B1 5/2003 Fujitsuka et al.
6,793,876 B2 9/2004 Kawakami et al.
7,294,167 B2 11/2007 Kawata et al.
2005/0132842 A1 6/2005 Kawata et al.

FOREIGN PATENT DOCUMENTS

CN 1837397 A 9/2006
DE 100 26 721 A1 2/2001

(Continued)

OTHER PUBLICATIONS

Urata, JP 04-072027 English abstract, Valve seat material for outboard motor and its production, Mar. 6, 1992.*

(Continued)

*Primary Examiner*—Roy King
*Assistant Examiner*—Jie Yang
(74) *Attorney, Agent, or Firm*—Oliff & Berridge, PLC

(57) ABSTRACT

A manufacturing method for wear resistant sintered member is provided. The method includes: compacting a raw powder containing a matrix forming powder and a hard phase forming powder into a green compact, the matrix forming powder containing 90 mass % or more of a powder having the maximum particle diameter of 46 μm, and the hard phase forming powder being 40 to 70 mass % with respect to the raw powder; and sintering the green compact.

15 Claims, 12 Drawing Sheets

FOREIGN PATENT DOCUMENTS

| | | | |
|---|---|---|---|
| EP | 0 240 879 | A2 | 10/1987 |
| EP | 1 405 929 | A1 | 4/2004 |
| GB | 1 445 501 | A | 8/1976 |
| JP | A-56-169748 | | 12/1981 |
| JP | B2 59-37343 | | 9/1984 |
| JP | A 64-68447 | | 3/1989 |
| JP | A-1-272704 | | 10/1989 |
| JP | A 2-163351 | | 6/1990 |
| JP | A 2-270943 | | 11/1990 |
| JP | A-2-270943 | | 11/1990 |
| JP | A-4-72027 | | 3/1992 |
| JP | A-4-298616 | | 10/1992 |
| JP | B2 5-55593 | | 8/1993 |
| JP | 07-070720 | A | 3/1995 |
| JP | B2 7-98985 | | 10/1995 |
| JP | 08-092706 | A | 4/1996 |
| JP | A 8-109450 | | 4/1996 |
| JP | 2002-285293 | A | 10/2002 |
| JP | A 2002-356704 | | 12/2002 |
| JP | A 2003-119542 | | 4/2003 |
| JP | A 2005-154798 | | 6/2005 |
| JP | 2006-299404 | A | 11/2006 |
| SU | 1107577 | A1 | 9/1992 |
| SU | 1763503 | A1 | 9/1992 |

OTHER PUBLICATIONS

Machine English translation of JP-04-298616 (Oct. 1992).*
British Office Action, mailing date Dec. 2, 2009.
Partial English-language translation of Japanese Office Action from Japanese Application No. 2005-308778, mailed Jun. 15, 2010.

* cited by examiner

MANUFACTURING METHOD FOR WEAR RESISTANT SINTERED MEMBER, SINTERED VALVE SEAT, AND MANUFACTURING METHOD THEREFOR

BACKGROUND OF THE INVENTION

1. Field of the Invention

The present invention relates to a manufacturing method for a wear resistant sintered member which is advantageously used for various sliding members. In particular, the present invention relates to a manufacturing method for a wear resistant sintered member which slides at high pressures. In addition, the present invention relates to a sintered valve seat for automobile engines, and relates to a production method therefor. In particular, the present invention relates to development techniques of sintered valve seat which is advantageously used for high load engines (for example, compression natural gas (=CNG) engines and heavy duty diesel engines).

2. Description of the Related Art

In sintered components manufactured by a powder metallurgy method, a desired hard phase is easily dispersed into an alloy matrix, and the sintered components are used for various sliding members (for example, sliding members for internal combustion engines and bearings used for automobiles and the like). However, in recent years, practical environments are severer in accordance with high performance of apparatuses having a sliding member provided therein. In order to cope with it, high wear resistance is required in sintered sliding members. In addition, wear resistance in various environments are required to be improved in accordance with wide application of sintered sliding members. For example, wear resistance and oxidation resistance at high temperatures are required depending on portions at which the sintered sliding members are used.

In order to meet the above requirements, Japanese Unexamined Patent Application Publications Nos. H08-109450, H02-270943, and H01-068447 (hereinafter referred to as "Patent Publication 1", "Patent Publication 2" and "Patent Publication 3") propose a wear resistant sintered member for various applications, in which a Co—Mo—Si—Cr based hard phase or a high-speed steel based hard phase which is dispersed. Japanese Unexamined Patent Application Publication Nos. 2002-356704, 2003-119542, and H01-154798 (hereinafter referred to as "Patent Publication 4", "Patent Publication 5" and "Patent Publication 6") propose a wear resistant sintered member in which various improved hard phase are dispersed.

In particular, in recent years, operation conditions of automobile engine are very sever due to high performance thereof. Valve seats for engine are required to endure practical environments which are severer than those of conventional techniques. For example, in liquefied petroleum gas (=LPG) engine widely used in automobile for taxi, since sliding surfaces of valve and valve seat are used in dry conditions, wear occurs more quickly than that in valve seat for gasoline engine. In environments in which sludge is adhered to a valve seat for highly leaded gasoline engine, when a pressure to valve seat is high or when a valve seat is used in high temperature and high compression ratio condition, wear is accelerated by the sludge. When a valve seat is used in the above severe environments, the valve seat is required to have good wear resistance and high strength for prevention of deformation by plastic flow in high temperature.

On the other hand, a valve operating mechanism equipped with a rush adjuster, which can automatically control a position of valve and a drive timing of valve even when valve seat is worn, has been used. However, an engine life problem due to wear of a valve seat is not solved, and development of materials for a valve seat which is superior in wear resistance is desired. In recent years, not only high performance but also development of inexpensive automobile has been important from viewpoint of economic efficiency. Therefore, a sintered alloy for a valve seat is required to be highly wear resistant and have a high strength without an additional mechanism such as the above rush adjuster.

Regarding the above sintered alloy used for a valve seat, Japanese Examined Patent Application Publication No. S59-037343 (hereinafter referred to as "Patent Publication 7") proposes a technique in which Co—Mo—Si based hard particles are dispersed into a dapped matrix of Fe—Co based matrix and an Fe—Cr based matrix. Japanese Examined Patent Application Publication No. H05-055593 (hereinafter referred to as "Patent Publication 8") proposes a technique in which Co—Mo—Si based hard particles are dispersed into an Fe—Co based matrix. Japanese Examined Patent Application Publication No. H07-098985 (hereinafter referred to as "Patent Publication 9") proposes a technique in which Co—Mo—Si based hard particles are dispersed into an Fe—Co based matrix containing Ni. Japanese Unexamined Patent Application Publication No. H02-163351 hereinafter referred to as "Patent Publication 10") proposes an Fe base alloy including Co—Mo—Si base hard particles dispersed thereinto.

SUMMARY OF THE INVENTION

The hard phases proposed in Patent Publications 1 to 6 described above exhibit good properties. However, when a hard phase forming element is added to the hard phases in order to greatly improve the wear resistance thereof, it has been known that wear resistance and strength thereof decrease all the more. Therefore, if the decrease in wear resistance due to the addition of a large amount of the hard phase forming powder element can be prevented, the hard phase can be effectively used, and the wear resistance can be greatly improved.

An object of the present invention is to provide a manufacturing method for a wear resistant sintered member, which can disperse a larger amount of the hard phase to the matrix without decreasing the wear resistance and the strength thereof.

In addition, although the hard particle in each alloy disclosed in Patent Publications 1 to 6 described above contains 40 mass % or less of Mo, the sintered alloy including the above hard particle has a high wear resistance at high temperatures and a high strength. However, in recent years, a sintered alloy is desired to be more wear-resistant at high temperatures and has higher strength. In particular, in engines (for example, CNG engines and high-power heavy duty diesel engines), practical use becomes severe due to metal contact is much higher, so that development of material which is more wear-resistant in the above environments is desired.

Another object of the present invention is to provide a sintered valve seat which is superior in wear resistance at high temperatures in high load engine environments of CNG engine, heavy duty diesel engine and the like. Another object of the present invention is to provide a manufacturing method for the above wear resistant sintered alloy.

According to one aspect of the present invention, a manufacturing method for wear resistant sintered member includes: compacting a raw powder containing a matrix forming powder and a hard phase forming powder into a green compact. The matrix forming powder contains 90 mass % or more of a powder having the maximum particle diameter of 46 μm or less, and amount of the hard phase forming powder being 40 to 70 mass % with respect to the raw powder. The manufacturing method further includes: sintering the green compact.

Since the hard phase forming powder is hard, the compressibility of the raw powder decreases and the density of the green compact decreases when a large amount of the hard phase forming powder is contained in the raw powder. When the green compact having the low density is sintered, the density does not increase and the sintered compact has a low density. Due to this, strength and wear resistance decrease. In addition, when the density of the green compact is intended to be forcibly increased by increasing a compacting pressure in the compacting, since the hard phase forming powder which is hard has a high elastic coefficient, the hard phase forming powder which was compressed in a die and recovers from elastic deformation when the green compact is ejected from the die after the compacting. As a result, since densified condition of particles by the compacting is deteriorated, bonding (neck growth) of the particles is not performed by the sintering, so that strength and wear resistance of the sintered compact decrease.

On the other hand, when a fine powder is used as the raw powder, as known in general, surface areas of the overall particles of the powder become large, and contact areas of the particles are thereby increased. As a result, the sintering of the green compact can be enhanced and the sintered compact can be densified. However, using of the fine powder causes decrease in fillability and compressibility of the raw powder. Due to this, a fine powder is not used in typical methods for improving a density of green compact.

The inventors focused a fine powder of which compressibility is not good but density is improved by sintering, and have found that a fine powder is mixed with a hard phase forming powder. As a result, the inventors found that the fine powder is densified by adding predetermined amount or more so that wear resistance and strength of sintered compact greatly increase. One aspect of the present invention was made based on the above findings and is characterized as follows. That is, the manufacturing method for wear resistant sintered member includes: compacting a raw powder containing a matrix forming powder and a hard phase forming powder into a green compact. The matrix forming powder contains 90 mass % or more of a fine powder having the maximum particle diameter of 46 μm or less, and amount of the hard phase forming powder being 40 to 70 mass % with respect to the raw powder. The manufacturing method further includes: sintering the green compact. In the manufacturing method, although a large amount of the hard phase forming powder and the matrix forming powder which is a fine powder are used, compressibility is deteriorated, the effect of densification by increase in surface areas of the overall particles of the fine powder after the sintering is advantageously obtained. Therefore, since the sintered compact can have a sufficient sintered density, properties of the hard phase forming powder can be exerted, so that wear resistance and strength can be improved.

The raw powder having the maximum particle diameter of 46 μm can be obtained by classification using a 325-mesh sieving screen. In this case, when the powder has a large aspect ratio (major axis/minor axis), the powder has a major axis of more than 46 μm and a minor axis of 46 μm or less may pass through the sieving screen. The powder passing through the sieving screen is a fine powder having the maximum particle diameter of 46 μm of the present invention. In order to obtain the above effects of the present invention, the matrix forming powder should contain 90 mass % or more of the powder having the maximum particle diameter of 46 μm or less.

Since the densification of the fine powder by the sintering can be sufficiently performed by densifying the matrix forming powder, it is unnecessary that the hard phase forming powder not be fine in particular, and a powder having a conventional particle diameter distribution may be used for the hard phase. As the amount of the fine powder contained in the hard phase forming powder is larger, the densification can be more greatly performed, so that this case is desirable.

When a fine powder is used in a typical powder metallurgy method, flowability and fillability of the raw powder decrease. In order to cope with it, a method in which a fine powder is granulated to have a predetermined particle diameter is used. This granulation method may be applied to the manufacturing method for wear resistant sintered member of the present invention.

The hard phase forming powder may not only be one disclosed in Patent Publications 1 to 6 but also may form a hard phase in which at least one of silicide, carbide, boride, nitride, and intermetallic compound is dispersed in an alloy phase by the sintering. In particular, the hard phase forming powder desirably consists of: all by mass %, 20 to 60% of Mo; 3 to 12% of Cr; 1 to 12% of Si; and the balance of Co and inevitable impurities. The hard phase formed by the above hard phase forming powder has a metal structure in which a precipitation mainly composed of Mo silicide providing wear resistance and lubricity is dispersed into the Co alloy phase having corrosion resistance and heat resistance, so that the effects of wear resistant member can be greatly obtained.

The matrix forming powder may be a conventional powder used in the Patent Publications 1 to 6 described above. For example, the raw powder can contain 1.2 mass % of a graphite powder for strengthening a Fe base matrix and forming a carbide. The raw powder can contain a powder composed of manganese sulfide, magnesium meta-silicate mineral or the like for improving machinability.

In sliding members of internal combustion engines, corrosion resistance is also required. In order to cope with it, when a stainless steel powder is used as the matrix forming powder, wear resistance can be secured and corrosion resistance can be simultaneously improved in the wear resistant sintered member. The kind of stainless steel powder can be freely selected. For example, a ferrite based stainless steel which contains 11 to 32 mass % of Cr and is highly corrosion-resistant to oxidizing acids can be used. A martensite based stainless steel in which 0.15 to 1.2 mass % of C is contained in the ferrite based stainless steel so as to improve strength and wear resistance can be used. An austenite stainless steel which contains 11 to 32 mass % of Cr and 5 to 22 mass % of Ni so as to improve corrosion resistance to no-oxidizing acids can be used.

The stainless steel can contain 0.3 to 7 mass % of Mo so as to improve creep resistance, oxidation resistance, corrosion resistance, pitting corrosion and free machinability. The stainless steel can contain 1 to 4 mass % of Cu so as to improve oxidation resistance, corrosion resistance and pitting corrosion resistance and provide precipitation hardenability. The stainless steel can contain 0.1 to 5 mass % of Al so as to improve weldability and heat resistance and provide precipitation hardenability. The stainless steel can contain 0.3 mass % or less of N so as to control crystal grains. In this case, since N is used instead of Ni, the content of Ni which is expensive can be reduced. In addition, since Mn can be used instead of Ni, the stainless steel can contain 5.5 to 10 mass % of Mn for decrease in the Ni content. The stainless steel can contain 0.15 to 5 mass % of Si so as to improve oxidation resistance, heat resistance and sulfate resistance. The stainless steel can contain 0.45 mass % or less of Nb so as to improve intergranular corrosion resistance. The stainless steel can contain 0.15 mass % or less of Se so as to improve weldability. The stainless steel can contain 0.2 mass % or less of P and 0.15 mass % or less of S so as to improve machinability.

According to another aspect of the present invention, first to third sintered valve seats by difference of metal structure are provided.

1. First Sintered Valve Seat

The present invention provides first to third sintered valve seats by difference of metal structure. These valve seats and manufacturing methods therefor will be explained hereinafter. The first sintered valve seat has a basic structure and contains a structure having a hard phase in which Mo suicides are precipitated in a Co base alloy phase and which is dispersed in a matrix at a amount of 40 to 70 mass %. The matrix consists of at least one structure except for pearlite, sorbite, and bainite. The hard phase consists of: 20 to 60 mass % of Mo; 3 to 12 mass % of Cr; 1 to 5 mass % of Si; and the balance of Co and inevitable impurities. FIGS. 4A and 4B are schematic diagrams showing a metal structure of the first sintered valve seat. Metal structure, contained elements of valve seat, and the like will be explained hereinafter.

The hard phase will be explained hereinafter. As described above, the hard phase consists of: 20 to 60 mass % of Mo; 3 to 12 mass % of Cr; 1 to 5 mass % of Si; and the balance of Co and inevitable impurities. In the hard phase, Mo silicides are mainly precipitated in a Co base alloy phase. In the sintered valve seat of the present invention, the hard phase is dispersed in a matrix at a amount of 40 to 70 mass %.

FIG. 7 is a schematic diagram showing a metal structure of valve seat composed of conventional wear resistant sintered alloy. As shown in FIG. 7, in the conventional valve seat, 5 to 40 mass % of hard phase is dispersed in matrix, and Mo silicides are precipitated and gathered in alloy phase of the hard phase. In this metal structure, since the amount of the hard phase is small, when valve seat exists under high pressure such that matrix portion which is other than the hard phase directly contacts a contacting member and slides thereon, the matrix portion initiates plastic flow and adhesion. As a result, the hard phase cannot resist the above pressure and wear occurs.

In contrast, in the sintered valve seat of the present invention, since the dispersed amount of the hard phase is 40 to 70 mass % which is larger than that of the conventional technique, even when valve seat exists under high pressure, matrix portion which is other than the hard phase is difficult to directly contact a contacting member. Even when the hard phase contacts it and the matrix portion initiates plastic flow and adhesion, deformation of the matrix portion is prevented by a large amount of the hard phase and wear is difficult to occur. It should be noted that the dispersed amount of the hard phase is desirably more than 40 mass %.

In the hard phase of the present invention, when the Mo content is about 45 mass % or less, as shown in FIG. 4A, the Mo silicide is precipitated and gathered in a grain form. On the other hand, when the amount of the Mo silicide is about 48 mass % or more, as shown in FIG. 4B, the Mo silicide is integrally precipitated. In the sintered valve seat of the present invention, since a large amount of the hard phase is dispersed in the matrix so as to improve wear resistance, the precipitated Mo suicide may have one of the above features.

In the sintered valve seat of the present invention, since 40 to 70 mass % of the hard phase which is a large amount is dispersed in the matrix of the valve seat, the wear resistance is very good. Since the hard phase forming powder deteriorates the compressibility, when the amount of the hard phase is small, the density ratio of the green compact is high. Even when the amount of the hard phase is less than 40 mass %, the density ratio is 90 mass % or more which is large, so that the wear resistance is advantageous only in consideration of the density ratio. However, in the sintered valve seat of the present invention, wear resistance is greatly and advantageously improved in comparison with the decrease in compressibility. On the other hand, when the amount of the hard phase is more than 70 mass %, the influence of decrease in compressibility of the raw powder is large, so that the density of the green compact greatly decreases. As a result, the density of the sintered compact (valve seat) decreases, the strength of the matrix decreases and wear resistance decreases all the more.

The hard phase is formed as follows. That is, a matrix forming powder used in the conventional sintered valve seat is mixed with a hard phase forming powder consisting of: 20 to 60 mass % of Mo; 3 to 12 mass % of Cr; 1 to 12 mass % of Si; and the balance of Co and inevitable impurities, so that a raw powder is obtained. The raw powder is compacted into a green compact, and the green compact is sintered, so that the hard phase is formed.

The reasons for the content limitations of respective elements in the hard phase are as follows.

Mo is mainly bonded with Si, so that Mo silicide having good wear resistance and lubricity is formed, and wear resistance of sintered alloy is thereby improved. In addition, a portion of Mo silicide forms a compound silicide containing Co. Furthermore, a portion of the compound silicide is diffused into Fe base matrix and contributes bonding of the hard phase, and it contributes improvement of hardenability of the Fe base matrix, improvement of heat resistance, improvement of corrosion resistance, improvement of wear resistance by formed carbide and the like. When the Mo content is less than 20 mass %, the precipitated amount f the Mo silicide is small, and the improvement of wear resistance is insufficient.

On the other hand, when the Mo content is 20 mass % or more, the sufficient amount of the Mo silicide is precipitated so that wear resistance is improved. The amount of the precipitated Mo silicide increases in proportion to the Mo content contained in the hard phase. When the Mo content is about 45 mass % or less, as shown in FIG. 4A, the Mo silicide is precipitated and gathered in a grain form. When the Mo content is more than about 45 mass %, precipitated grains of the Mo silicide increase, thereby starting bonding with each other. When the amount of the Mo silicide is about 48 mass % or more, as shown in FIG. 4B, the Mo silicide is integrally precipitated. When the Mo content exceeds 60 mass %, the hardness of the hard phase forming powder becomes high, the compressibility of the raw powder is deteriorated, and the density ratio of valve seat is less than 90% even by the following manufacturing method. As a result, the strength of the matrix decreases, so that the wear resistance decreases all the more. Since the formed hard phase is fragile, a portion of valve seat is broken by applied impacts, and the wear resistance decreases all the more due to the broken particles as an abrasive powder. Thus, the Mo content in the hard phase is 20 to 60 mass %.

The precipitated feature of the Mo silicide may be the feature of Mo silicide precipitated and gathered in a grain form or the feature of Mo silicide integrally precipitated. In the former feature of Mo silicide precipitated and gathered in a grain form, when metal contact occurs, alloy phase portion of the hard phase, which is other than the Mo silicide functioning as hard particles, initiates plastic flow and adhesion, so that wear easily occurs. On the other hand, in the latter feature of Mo silicide integrally precipitated, generation of plastic flow and adhesion of alloy phase portion of the hard phase can be inhibited by pinning effect, and wear resistance can be improved. Therefore, the latter feature of Mo silicide integrally precipitated is desirable.

Cr improves strength of Co base matrix of the hard phase. Cr is diffused into Fe base matrix, so that the hard phase is bonded to the Fe base matrix, and Cr is solid-solved in the Fe base matrix, so that the Fe base matrix is strengthened. Due to these, wear resistance is improved. Cr is diffused into the Fe base matrix so as to improve bonding of the hard phase and contribute improvement of hardenability of the Fe base matrix, improvement of corrosion resistance by formed passive film, improvement of wear resistance by formed carbide and the like. In addition, in the following second sintered valve seat, Cr diffused from the hard phase forming powder into the Fe base matrix is bonded with S supplied by sulfide powder, so that Cr sulfide having good lubricity is formed around the hard phase, and wear resistance is improved. When the Cr content in the hard phase is less than 3 mass %, the above effects are insufficient. On the other hand, when the Cr content in the hard phase exceeds 12 mass %, since Cr is easily oxidized, oxide film is formed on surface of the powder, so that sintering of green compact is inhibited. In addition, hardness of the powder is higher, so that compressibility of the powder in compacting is deteriorated. Due to these, the density ratio of valve seat even by the following manufacturing method is less than 90%, so that strength of the matrix decreases, and wear resistance thereby decreases all the more. Thus, the Cr content in the hard phase is 3 to 12 mass %.

Si mainly reacts with Mo, so that Mo silicide having good wear resistance and lubricity is formed, and wear resistance of sintered alloy is thereby improved. When the Si content is less than 1 mass %, Mo silicide is not sufficiently obtained, and wear resistance is not sufficiently improved. On the other hand, when the Si content is excessive, Si which reacts with Mo and is diffused in the matrix increases. Some degree of the diffusion of Si into matrix is effective for the bonding of hard phase to matrix and the improvement of wear resistance by hardening of Fe base matrix. However, the Fe base matrix is too hard and fragile by excessive degree of the diffusion of Si into matrix, so that the wear resistance decreases and the attackability to a contacting member of the of the valve seat increases. Therefore, the excessive degree of the diffusion of Si into matrix is undesirable. In this case, when Si which does not react with Mo is reduced, the appropriate Mo content can be supplied without increasing hardness of the powder. Therefore, the upper limit of the Si content in the hard phase is 5 mass % at which Si diffused into matrix without reacting with Mo starts increasing. Thus, the Si content in the hard phase is 1 to 5 mass %.

Co which is as alloy matrix of hard phase improves heat resistance and corrosion resistance of the hard phase. Co is diffused into the Fe base matrix, so that the hard phase bonds with the Fe base matrix and heat resistance of the Fe base matrix is improved.

The matrix will be explained hereinafter. In observation of metal structure of the sintered valve seat of the present invention, when the valve seat is corroded by nitric acid ethanol or the like, the metal structure is seen such that the hard phase is dispersed into the overall white matrix structure. The overall white metal structure is formed by diffusion of respective alloy elements, which are contained in the hard phase, into the Fe base matrix. Since the amount of the contained hard phase is large, the effect is reflected on the overall surface of the metal structure. That is, in this white matrix structure, each alloy element from the hard phase is solid-solved, so that wear resistance, corrosion resistance, heat resistance and the like are improved. When the diffusion of respective elements from the hard phase is insufficient, the portion remains as pearlite, sorbite, or bainite, so that the above effect is insufficient. Due to this, the matrix structure of the sintered valve seat of the present invention should not contain structures (that is, pearlite, sorbite, and bainite) which are insufficiently wear-resistant, corrosion-resistant and heat-resistant. Specifically, the matrix structure is one of ferrite (high-alloy ferrite), retained austenite and martensite or mixture thereof. The matrix structure is more desirably one of retained austenite, martensite and mixture thereof.

As described above, in the matrix of sintered valve seat of the present invention, the diffusion of respective elements from a large amount of the dispersed hard phase improves various properties required in valve seat. The matrix desirably contains at least one of the following elements of alloy. The reasons for the content limitations of the elements in the matrix are as follows.

Mo improves hardenability of the matrix so as to improve strength and wear resistance. Mo improves softening resistance of the tempered matrix so as to prevent decrease in wear resistance which caused by repeated use. Mo improves strength at high temperatures and creep strength so as to improve strength and wear resistance. Mo hardens austenite so as to improve strength and wear resistance. Mo forms carbide so as to improve wear resistance. Mo is sold-solved with Cr so as to improve corrosion resistance. When the Mo content supplied to the matrix is less than 0.2 mass %, the above effects are insufficient. In addition, the diffusion speed of Mo is relatively low, and Mo is more desirably supplied by alloy powder than by single powder. When the Mo content exceeds 5 mass %, the hardness of alloy powder increases, so that the compressibility of raw powder is deteriorated all the more. Thus, the Mo content in the matrix is 0.2 to 5 mass %.

Cr improves hardenability of the matrix so as to improve strength and wear resistance. Cr forms passive film so as to improve corrosion resistance. Cr forms carbide so as to improve wear resistance. Cr hardens austenite so as to improve strength and wear resistance. When the Cr content supplied to the matrix is less than 0.05 mass %, the above effects are insufficient. Since Cr is easily oxidized, when Cr is supplied by single powder, diffusion of element is not performed due to solid oxide. Therefore, Cr is supplied by alloy powder. When the Cr content exceeds 4 mass %, the hardness of raw powder increases, so that the compressibility of raw powder is deteriorated all the more. Thus, the Cr content in the matrix is 0.05 to 4 mass %.

V hardens austenite so as to improve strength and wear resistance. V forms carbide so as to improve wear resistance. V improves softening resistance of the tempered matrix so as to prevent decrease in wear resistance which caused by repeated use. V prevents coarsening of crystal grains of austenite so as to improve strength and wear resistance. When the V content supplied to the matrix is less than 0.05 mass %, the above effects are insufficient. In addition, the diffusion speed of V is relatively low, and V is more desirably supplied by alloy powder than by single powder. In this case, when the V content exceeds 6 mass %, the hardness of alloy powder increases, so that the compressibility of raw powder is deteriorated all the more. Thus, the V content in the matrix is 0.05 to 6 mass %.

Ni improves hardenability of matrix so as to improve strength and wear resistance. Ni forms austenite so as to provide ductility to matrix. Ni improves corrosion resistance of matrix together with Cr. When the Ni content supplied to the matrix is less than 0.1 mass %, the above effects are insufficient. When the Ni content supplied to the matrix exceeds 10 mass %, austenite which is superior in corrosion resistance and ductility but is inferior in wear resistance excessively exists, so that wear resistance decreases all the more. In addition, when Ni is supplied by alloy powder, the hardness of raw powder increases, so that the compressibility of raw powder is deteriorated all the more. Thus, the Ni content in the matrix is 0.1 to 10 mass %. Since diffusion speed of Ni to Fe base matrix is relatively high, Ni may more be supplied by single powder or by alloy powder.

Cu improves hardenability of matrix so as to improve strength and wear resistance. When the Cu content supplied to the matrix is less than 0.5 mass %, the above effects are insufficient. When the Cu content supplied to the matrix exceeds 5 mass %, a large amount of free copper phase which is soft is dispersed in matrix structure, so that wear resistance decreases. Thus, the Cu content in the matrix is 0.5 to 5 mass %. Since diffusion speed of Cu to Fe base matrix is relatively high, Cu may more be supplied by single powder or by alloy powder.

Co provides heat resistance to matrix so as to prevent decrease in strength and wear resistance. Co is solid-solved in austenite so as to maintain hardness of matrix against repeated use. When the Co content supplied to the matrix is less than 5.5 mass %, the above effects are insufficient. In addition, the diffusion speed of Co is relatively low, and Co is more desirably supplied by alloy powder than by single powder. In this case, when the Mo content exceeds 7.5 mass %, the hardness of alloy powder increases, so that the compressibility of raw powder is deteriorated all the more. Thus, the Co content in the matrix is 5.5 to 7.5 mass %.

The matrix structures containing the above alloy elements can be obtained by using at least one selected from the following steel powders (A) to (E). That is, the steel powder (A) consists of: 1.5 to 5 mass % of Mo; and the balance of Fe and inevitable impurities. The steel powder (B) consists of: 2 to 4 mass % of Cr; 0.2 to 0.4 mass % of Mo; 0.2 to 0.4 mass % of V; and the balance of Fe and inevitable impurities. The steel powder (C) consists of: 5.5 to 7.5 mass % of Co; 0.5 to 3 mass % of Mo; 0.1 to 3 mass % of Ni; and the balance of Fe and inevitable impurities. The steel powder (D) consists: of 0.4 to 4 mass % of Mo; 0.6 to 5 mass % of Ni; 0.5 to 5 mass % of Cu; 0.05 to 2 mass % of Cr; 0.05 to 0.6 mass % of V; and the balance of Fe and inevitable impurities. The partially diffusion bonding alloy powder (E) consists of: 1 to 10 mass % of Ni; 1 to 3 mass % of Cu; 0.4 to 1.0 mass % of Mo; and the balance of Fe and inevitable impurities. The above steel powders are used in the conventional sintered valve seat, and are inexpensively got in market. One of the above steel powders may be used. Mixture thereof may be used so as to be within the above composition ranges. The above steel powders may be mixed with at least of one of a Ni powder and a Cu powder.

The manufacturing method for the sintered valve seat of the present invention will be explained hereinafter. The sintered valve seat contains 40 to 70 mass % (which is a large amount) of the hard phase in the matrix and the matrix does not have pearlite, sorbite, and bainite. A portion, in which respective alloy elements are insufficiently diffused from the hard phase into the Fe base matrix, has a low heat resistance and a low corrosion resistance. The portion is formed when distance between surface of particle of the matrix forming powder and center thereof exceeds diffusion distances. Therefore, a powder having particles having a distance between surface of particle of the powder and center thereof, which is smaller than diffusion distances of respective alloy elements, is used, that is, a fine powder is used, so that alloy elements are uniformly diffused from the hard phase to the overall Fe matrix. As a result, the effects by the above elements can be obtained in the overall matrix. Therefore, in the manufacturing method for the sintered valve seat of the present invention, the matrix forming powder has the maximum particle diameter of 74 μm. On the other hand, when a powder having a particle diameter of more than 74 μm is contained in the matrix forming powder, a portion, of which corrosion resistance and heat resistance are insufficient (for example, pearlite, sorbite, and bainite), easily remains in the matrix structure.

In the sintered valve seat of the present invention, a large amount of the hard phase is dispersed. In order to increase the amount of the hard phase dispersed in the matrix, the sintered valve seat cannot have a good density ratio when the amount of the hard phase forming powder added to the raw powder is merely increased. That is, since the hard phase forming powder is hard, when a large amount of the hard phase forming powder is contained in the raw powder, the compressibility of the raw powder decreases and the density of green compact decreases. When the green compact having the low density is sintered, the density does not increase and the sintered compact has a low density. Due to this, strength and wear resistance decrease. In addition, when the density of the green compact is intended to be forcibly increased by increasing a compacting pressure in the compacting, since the hard phase forming powder which is hard has a high elastic coefficient, the hard phase forming powder which was compressed in a die and recovers from elastic deformation when the green compact is ejected from the die after the compacting. As a result, since densified condition of particles by the compacting is deteriorated, bonding (neck growth) of the particles are not performed by the sintering, so that the strength and the wear resistance of the sintered compact decreases. On the other hand, when a fine powder is used as the raw powder as described above, surface areas of the overall particles of the powder becomes large, and contact areas of the particles thereby increase. As a result, the sintering of the green compact can be enhanced and the sintered compact can be densified. Therefore, when the raw powder contains a large amount of the hard phase forming powder, the sintered compact can have a desired density as the sintered valve seat.

When the amount of the hard phase forming powder added in the raw powder is 40 to 70 mass %, the matrix forming powder has the maximum particle diameter of 74 μm or less, so that the structure in which pearlite, sorbite, and bainite do not remain in the matrix structure is obtained, and the sintered compact can have a desired density as the sintered valve seat. The finer the matrix forming powder, the smaller the distance between surface of particle of the powder and center thereof, and the larger the surface area. As a result, the densification is performed more easily. Therefore, in order to obtain the above effects, the matrix forming powder has a particle diameter distribution such that the matrix forming powder contains: 90 mass % or more of particles having the maximum particle diameter of 46 μm or less; and the balance particles having the maximum particle diameter of 74 μm or less.

When the hard phase forming powder is fine, the compressibility of the raw powder is deteriorated much more, so that the hard phase forming powder should have the maximum particle diameter of 150 μm which is large to some degree. When a powder containing: 40 mass % or more of particles having the maximum particle diameter of 74 μm is used as the hard phase forming powder, the size of the hard phase forming powder with respect to the matrix forming powder is secured and the compressibility is slightly deteriorated.

A graphite powder is diffused into the matrix forming powder in the sintering, thereby strengthening the Fe base matrix. A portion of the graphite powder is precipitated as carbide and improves wear resistance of the matrix and the hard phase. When the added amount of the graphite powder is less than 0.8 mass %, the above effects are insufficient. On the other hand, when the added amount of the graphite powder exceeds 2.0 mass %, the precipitated amount of the carbide is excessive and strength of the matrix decreases all the more. Due to this, wear resistance decreases all the more and attackability to a contacting member of the valve seat increase. Thus, the added amount of the graphite powder should be 0.8 to 2.0 mass %.

A manufacturing method for the sintered valve seat of the present invention is obtained based on the above findings. The manufacturing method includes: preparing a matrix forming powder having the maximum particle diameter of 74 μm, a hard phase forming powder having the maximum particle diameter of 150 μm and a graphite powder. The hard phase forming powder consists of 20 to 60 mass % of Mo, 3 to 12 mass % of Cr, 1 to 5 mass % of Si, and the balance of Co and inevitable impurities. The manufacturing method further contains: mixing 40 to 70 mass % of the hard phase forming powder, 0.8 to 2.0 mass % of the graphite powder, and the balance of the matrix forming powder to prepare a raw powder. The manufacturing method further contains: compacting the raw powder into a green compact; and sintering the green compact.

The powder having the maximum particle diameter of 74 μm is a powder passing through a 200-mesh sieving screen. The powder having the maximum particle diameter of 46 μm is a powder passing through a 300-mesh sieving screen. The powder having the maximum particle diameter of 150 μm is a powder passing through a 90-mesh sieving screen. Therefore, the powders can have the above particle diameters by using the above sieving screens.

The matrix forming powder can use one of the above steel powders (A) to (E) or mixture thereof. The above steel powders may be mixed with at least of one of a Ni powder and a Cu powder in order to strengthen the matrix.

2. Second Sintered Valve Seat

In the second sintered valve seat, Cr sulfide is precipitated and dispersed around the hard phase in the metal structure of the above first sintered valve seat. FIGS. 5A and 5B are schematic diagrams showing the metal structure of the second sintered valve seat. Since Cr sulfide which has good lubricity is precipitated and dispersed around the hard phase, a load on the hard phase is slipped and is out of the hard phase. As a result, plastic flow of the hard phase is prevented, so that wear resistance is improved more. FIG. 5A shows a feature in which Mo silicide is precipitated and gathered in the hard phase. FIG. 5B shows a feature in which Mo suicide is integrally precipitated in the hard phase. The Cr sulfides precipitated in the hard phase shown in FIGS. 5A and 5B improve lubricity.

In order to precipitate the Cr sulfide in the hard phase, the raw powder contains at least one sulfide powder selected from the group consisting of powders (F) to (I) such that the amount of S in the raw powder is 0.04 to 5 mass %. The powder (F) is molybdenum disulfide powder. The powder (G) is tungsten disulfide powder. The powder (H) is iron sulfide powder. The powder (I) is copper sulfide powder. Sulphur generated by decomposing the powders (F) to (I) in the sintering reacts with Cr diffused from the hard phase forming powder to the Fe base matrix.

As described in Reference (Chemical Unabridged Dictionary, 9th Edition, Published by Kyoritsu Shuppan Co., Ltd, Mar. 15, 1964), all sulfides are not chemically stable, and some sulfides are easily decomposed in sintering. Molybdenum disulfide ($MoS_2$), tungsten disulfide ($WS_2$), iron sulfide (FeS), and copper sulfide (CuS) are easily decomposed in a specific condition. It is conceived that, in actual sintering process, the above sulfides are decomposed when decomposition condition is satisfied by water, oxygen, and hydrogen contained in an atmosphere, and by water and oxygen which are absorbed to a surface of an iron powder. It is conceived that the sulfide reacts with an activated metal surface at a high temperature, and the activated metal surface functions as a catalyst, so that decomposition of the sulfide may be promoted. It is confirmed that manganese sulfide (MnS) and chrome sulfide (CrS) are difficult to be decomposed as shown in the Reference 1. The ability of forming sulfide relates to electro-negativity, and S is easily bonded with an element having low electro-negativity and sulfides are formed. The electro-negativity of each element is arranged in a magnitude thereof as follows. Each numeral in round brackets denotes the electro-negativity of the element. Since Mn is the most easily bonded with S, manganese sulfides are preferentially precipitated. The above order corresponds to the description of the Reference 1. Therefore, in the manufacturing method for the second sintered valve seat, the sulfide powder containing at least of one of the above (F) to (I) powders are used in order to supply S.

$$Mn(1.5)<Cr(1.6)<Fe,Ni,Co,Mo(1.8)<Cu(1.9)$$

In order to precipitate and disperse a large amount of Cr sulfide particles into the hard phase by using the sulfide powder, the sulfide powder should be mixed to the raw powder such that the amount of S in the raw powder should be 0.04 mass % or more. On the other hand, when the sulfide powder is excessively mixed to the raw powder, pores, which have been formed at which the S powder existed and decomposed, increase, and strength of valve seat thereby decreases, so that wear resistance decreases. Thus, the upper limit of the S content in the raw powder should be 5 mass %. In addition, since the sulfide powder disappears by the decomposition, when the sulfide powder is coarse, portions at which the sulfide powder initially existed remains as pores. Therefore, the particle diameter of the sulfide powder is desirably 43 μm or less.

3. Third Sintered Valve Seat

A third sintered valve seat further contains 5 to 20 mass % of lubricant phase which is dispersed in the matrix of the second sintered valve seat. The lubricant phase has Cr sulfide particles which are precipitated and gathered. FIGS. 6A and 6B are schematic diagrams showing a metal structure of third sintered valve seat of the present invention. In the third sintered valve seat, Cr sulfides having good lubricity are dispersed around the hard phase, and they are dispersed and gathered in the matrix in a spotted form, so that lubricity of the matrix is improved. FIG. 6A shows a feature in which Mo silicide is precipitated and gathered in the hard phase. FIG. 5B shows a feature in which Mo silicide is integrally precipitated in the hard phase. The Cr sulfides precipitated in the hard phase shown in FIGS. 6A and 6B improve lubricity.

In cutting of valve seat by using a cutting tool, when sulfide is uniformly dispersed in matrix, edge of the cutting tool uniformly contacts the sulfide. Due to this, cutting resistance is reduced, and cut chip is easily removed by chip break action, so that store of heat to the edge of the cutting tool is prevented and temperature of the edge is lowered. In the above manner, machinability is improved. On the other hand, since sulfide particles are small, a large amount of sulfide is necessary in order to improve lubricity of matrix structure and wear resistance. However, when a large amount of sulfide is dispersed in the matrix, strength of the matrix is decreased.

Due to this, in the embodiment according to the present invention, Cr sulfides having good lubricity are dispersed and gathered in the matrix in a spotted form, so that wear resistance of matrix is improved by a small amount of Cr sulfide such that strength of matrix is not decreased. When the amount of the lubricant phase dispersed in the matrix is less than 5 mass %, lubricity improvement is insufficient, so that wear resistance is not improved sufficiently. On the other hand, when the amount of this lubricant phase dispersed in the matrix exceeds 20 mass %, strength of the matrix is greatly decreased. Thus, the amount of the lubricant phase dispersed in the matrix should be 5 to 20 mass %.

The above lubricant phase having Cr sulfide particles which are precipitated and gathered can be produced by mixing the raw powder with a Cr contained steel powder including 4 to 25 mass % of Cr. That is, S generated by decomposing the above sulfide powder in the sintering is bonded with Cr in the Cr contained steel powder, so that Cr sulfide is precipitated at a portion at which the Cr contained steel powder initially existed. As a result, the lubricant phase having Cr sulfide particles which are precipitated and gathered is formed. Therefore, composition of lubricant phase approximately corresponds to that of the initial Cr contained steel powder. That is, the lubricant phase contains 4 to 25 mass % of Cr. An alloy matrix which is a portion having Cr sulfide particles precipitated and gathered is a Fe—Cr based alloy matrix.

When the Cr content in the lubricant phase is less than 4 mass %, Cr sulfide is not precipitated, and wear resistance is not improved. On the other hand, when the Cr content in the lubricant phase is more than 25 mass %, the Cr contained steel powder becomes hard. As a result, compressibility thereof is deteriorated, and a phase is generated in the lubricant phase and the lubricant phase is fragile. Thus, the upper limit of the Cr content in the lubricant phase should be 25 mass % or more.

The lubricant phase can be formed by using the Cr contained steel powder. For example, the Cr contained steel powder is at least of one selected from the group consisting of Cr contained steel powders (L) to (Q). The Cr contained steel powder (L) is a Cr contained steel powder consisting of: 4 to 25 mass % of Cr; and the balance of Fe and inevitable impurities. The Cr contained steel powder (M) is a Cr contained steel powder consisting of: 4 to 25 mass % of Cr; 3.5 to 22 mass % of Ni; and the balance of Fe and inevitable impurities. The Cr contained steel powder (N) is a Cr contained steel powder consisting of: 4 to 25 mass % of Cr; at least one selected from the group consisting of 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se; and the balance of Fe and inevitable impurities. The Cr contained steel powder (O) is a Cr contained steel powder consisting of: 4 to 25 mass % of Cr; 3.5 to 22 mass % of Ni; at least one selected from the group consisting of 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se; and the balance of Fe and inevitable impurities. The Cr contained steel powder (P) is a Cr contained steel powder consisting of: 7.5 to 25 mass % of Cr; 0.3 to 3 mass % of Mo; 0.25 to 2.4 mass % of C; at least one of 0.2 to 2.2 mass % of V and 1.0 to 5.0 mass % of W; and the balance of Fe and inevitable impurities. The Cr contained steel powder (Q) is a Cr contained steel powder consisting of: 4 to 6 mass % of Cr; 4 to 8 mass % of Mo; 0.5 to 3 mass % of V; 4 to 8 mass % of W; 0.6 to 1.2 mass % of C; and the balance of Fe and inevitable impurities.

The above steel powder (L) is composed of Fe—Cr alloy and is known as a ferrite based stainless steel powder consisting of more than 12 mass % of Cr. A ferrite based stainless steel powder (for example, the above steel powder (N)) having properties which are improved by another element can be used. The above steel powder (M) is composed of Fe—Ni—Cr alloy and is known as an austenite stainless steel powder consisting of more than 12 mass % of Cr. An austenite stainless steel powder (for example, the above steel powder (O)) having properties which are improved by another element can be used. The above steel powder (P) is a powder of alloy tool steel for cold working mold or hot forming mold, in which contained Cr is originally precipitated as Cr carbide but large portion of contained Cr is precipitated as Cr sulfide when Cr exists with S in the sintered valve seat of the present invention. In this case, Cr carbide is remained at a portion of the Cr sulfide. Carbide which is selected from the group consisting of Mo carbide, V carbide, W carbide, and mixture thereof are precipitated. As a result, lubricant phase in which carbide exists with Cr sulfide is obtained. The above steel powder (Q) is known as a high speed steel powder. In the same manner as the above steel powder (P), Cr exists with S and is precipitated as Cr sulfide, and Cr carbide is remained at a portion of the Cr sulfide. Carbide selected from the group consisting of Mo carbide, V carbide, W carbide, and mixture thereof are precipitated. As a result, lubricant phase in which carbide exists with Cr sulfide is obtained.

In the third sintered valve seat of the present invention, carbides may be precipitated with Cr sulfide in the above lubricant phase. Specifically, when the above steel powders (P) and/or (Q) are used, a structure having carbides precipitated with Cr sulfide in the lubricant phase is formed. In this case, carbides are precipitated in the lubricant phase, so that plastic flow of alloy matrix portion of the lubricant phase is prevented, and wear resistance can thereby be greatly improved. In comparison of the case using the steel powder (P) and the case using the steel powder (Q), in the case using the steel powder (P), the amount of carbides is smaller than in the case using the steel powder (Q). And in the case using the steel powder (Q), lubricant phase having a large amount of precipitated carbides is obtained. The steel powders (P) and (Q) can be selectively used in accordance with desired properties of the lubricant phase.

In the above first to third sintered valve seats, conventional techniques of adding materials for improving machinability can be used. For example, at least one selected from the group consisting of magnesium meta-silicate mineral, boron nitride, manganese sulfide, calcium fluoride, bismuth, chromium sulfide, and lead is dispersed in pores and powder boundaries of the above wear resistant sintered members.

The above materials for improving machinability are chemically stable at high temperatures. Even if the powders of above materials for improving machinability are added to a raw material powder, the above materials are not decomposed in sintering and are dispersed in the pores and powder boundaries, so that the machinability of the wear resistant sintered member can be improved. When the above techniques of adding materials for improving machinability is used, the upper limit of amount of the above material for improving machinability should be 2.0 mass % in the wear resistant sintered member since the strength of the wear resistant sintered member and wear resistance thereof decrease when the above materials for improving machinability are excessively added.

In the sintered valve seat of the present invention, as disclosed in Patent Publication 8 and the like, at least one selected from the group consisting of lead or lead alloy, copper or copper alloy, and aclylic resin can be filled in the pores of the sintered valve seat by impregnating or infiltrating, so that the machinability can be improved.

That is, when lead or lead alloy, copper or copper alloy, or aclylic resin exists in the pores, cutting condition is changed from intermittently cutting to sequential cutting in machining the sintered valve seat, and impact given to a cutting tool used in the machining is reduced, so that the damage to the edge of the cutting tool is prevented, and the machinability of the sintered member is improved. Since lead, lead alloy, copper and copper alloy are soft, these materials are adhered to the edge of the cutting tool, so that the edge of the cutting tool is protected, the machinability is improved, and the service life of the cutting tool is prolonged. Furthermore, in using the cutting tool, the above materials function as solid lubricants between a valve seat and a face surface of a valve, so that the wear of them can be reduced. Since copper and copper alloy has high thermal conductivity, heat generated in the edge of the cutting tool is dissipated to outside, store of heat in the edge portion of the cutting tool is prevented, and damage to the edge portion is reduced.

In the wear resistant sintered member according to one aspect of the present invention, since the wear resistant sintered member can contain a large amount of the hard phase and have a sufficiently sintered density, wear resistance and strength can be improved in comparison with those of the conventional technique. When the matrix forming powder is a stainless steel powder, corrosion resistance of the matrix is improved, so that this case using the stainless powder as the matrix forming powder is desirable.

In the sintered valve seat of the present invention, since 40 to 70 mass % of the hard phase is dispersed in the matrix of the sintered valve seat, wear resistance can be greatly high at high temperatures in high load engine environments of CNG engine, heavy duty diesel engine and the like.

EMBODIMENTS

Embodiment 1

Figure 1:
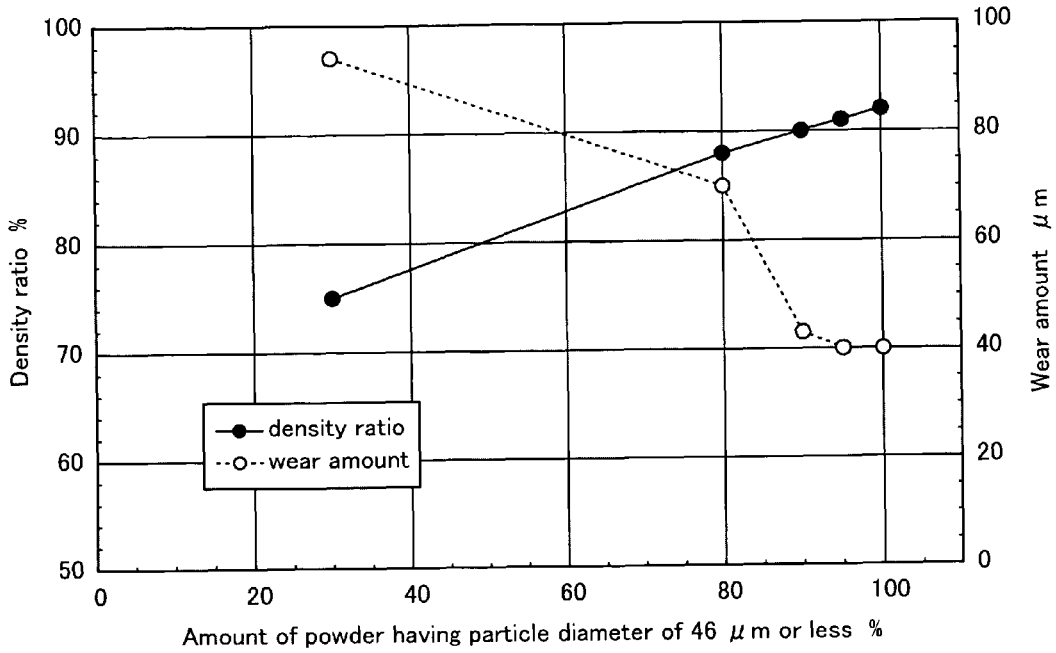
FIG. 1 is a graph showing the relationship of amount of powder having a particle diameter of 46 μm or less and density ratio and wear amount in the embodiments according to one aspect of the present invention.

Stainless steel powders were prepared as matrix forming powders and a Co base alloy powder was prepared as a hard phase forming powder. The stainless steel powder corresponded to a stainless steel SUS316 of the Japanese Industrial Standards (=JIS) and had a particle diameter distribution shown in Table 1. A Co base alloy powder consisted of: 28 mass % of Mo; 2.5 mass % of Si; 8 mass % of Cr; and the balance of Co and inevitable impurities. Next, the matrix forming powders were mixed with 60 mass % of the hard phase forming powder, so that raw powders were obtained. The raw powders were compacted into green compacts at a compacting pressure of 1.2 GPa. The green compacts had disc shapes having a diameter of 30 mm and a thickness of 10 mm. Next, the green compacts were sintered at 1250° C. for 1 hour in a decomposed ammonia gas atmosphere, so that the samples 01 to 05 shown in Table 1 were produced. Density ratios of the samples 01 to 05 were measured. Reciprocating slide wear tests were performed on the samples 01 to 05, and wear amount of the samples 01 to 05 were measured. These measured results were shown in Table 1.

In the reciprocating slide wear tests, a side surface of roll member (contacting member) was slidably reciprocated with respect to each sample while it was pressed thereon at a predetermined load. The roll member had a diameter of 15 mm and a thickness of 22 mm. The roll member was formed such that a surface of ingot steel corresponding to a stainless steel SUS316 of JIS was subjected to chromizing, that is, the surface of ingot steel was coated with Cr and hard Fe—Cr intermetallic compound layer was formed, so that wear resistance, seizure resistance corrosion resistance were improved. In the reciprocating slide wear tests, a load was 400N, a frequency of the reciprocating slide was 20 Hz, an amplitude thereof was 1.5 mm, a test duration thereof was 20 minutes, and a test temperature was a room temperature. These measured results were shown in Table 1 and FIG. 1.

TABLE 1

| | Mixing Ratio mass % | | | | Evaluation Item | | |
|---|---|---|---|---|---|---|---|
| | Matrix Forming Powder | Particle diameter Distribution % | | Hard Phase Forming Powder | | Wear Amount | |
| Sample No. | | 45 μm or less | more than 45 μm | | Density Ratio % | μm | Note |
| 01 | Balance | 100 | 0 | 60 | 92 | 40 | |
| 02 | Balance | 95 | 5 | 60 | 91 | 40 | |
| 03 | Balance | 90 | 10 | 60 | 90 | 43 | |
| 04 | Balance | 80 | 20 | 60 | 88 | 70 | Out of Range of Particle diameter Distribution of Present Invention |
| 05 | Balance | 30 | 70 | 60 | 75 | 94 | Conventional Example |

As shown in FIG. 1, in the sample 05 using the matrix forming powder including 30 mass % of fine powder, since the added amount of the hard phase forming powder was 60 mass % which was large, the density ratio of green compact decreased. Due to this, even when the green compact was sintered, the density ratio of sample 05 was 83% which was low, so that matrix strength decreased and wear amount increased. On the other hand, as the ratio of fine powder having a particle diameter of 46 μm or less in the matrix forming powder was higher, densification of the sample was improved more by the sintering. As a result, the density ratio of the sample linearly increased and wear amount was reduced. When the ratio of fine powder having a particle diameter of 46 μm or less in the matrix forming powder was 90% or more, the density ratio of the sample reached 90%, wear amount was rapidly reduced.

Embodiment 2

The stainless steel powder used in the sample 02 of the embodiment 1 was prepared as a matrix forming powder and the Co base alloy powder used in the embodiment 1 was prepared as a hard phase forming powder. The stainless steel powder corresponded to a stainless steel SUS316 of JIS and had the ratio of a particle diameter of 46 μm or less in the stainless steel powder being 95%. Next, the matrix forming powder was mixed with the hard phase forming powder at mixing ratios shown in Table 2, so that raw powders were obtained. The raw powders were compacted into green compacts and the green compacts were sintered in the same condition as in the embodiment 1, so that samples 06 to 10 were produced. The same tests as in the embodiment 1 were performed on the samples 06 to 10. The test results of the samples 06 to 10 and the test results of the sample 02 in the embodiment 1 are shown in Table 2 and FIG. 2.

TABLE 2

| | Mixing Ratio mass % | | Evaluation Item | | |
|---|---|---|---|---|---|
| Sample No. | Matrix Forming Powder | Hard Phase Forming Powder | Density Ratio % | Wear Amount μm | Note |
| 06 | Balance | 30 | 95 | 150 | Out of Lower Limit of Added Amount of Hard Phase Forming Powder |
| 07 | Balance | 40 | 94 | 65 | Lower Limit of Added Amount of Hard Phase Forming Powder |
| 08 | Balance | 50 | 92 | 52 | |
| 02 | Balance | 60 | 91 | 40 | |
| 09 | Balance | 70 | 90 | 60 | Upper Limit of Added Amount of Hard Phase Forming Powder |
| 10 | Balance | 80 | 80 | 120 | Out of Upper Limit of Added Amount of Hard Phase Forming Powder |

Figure 2:
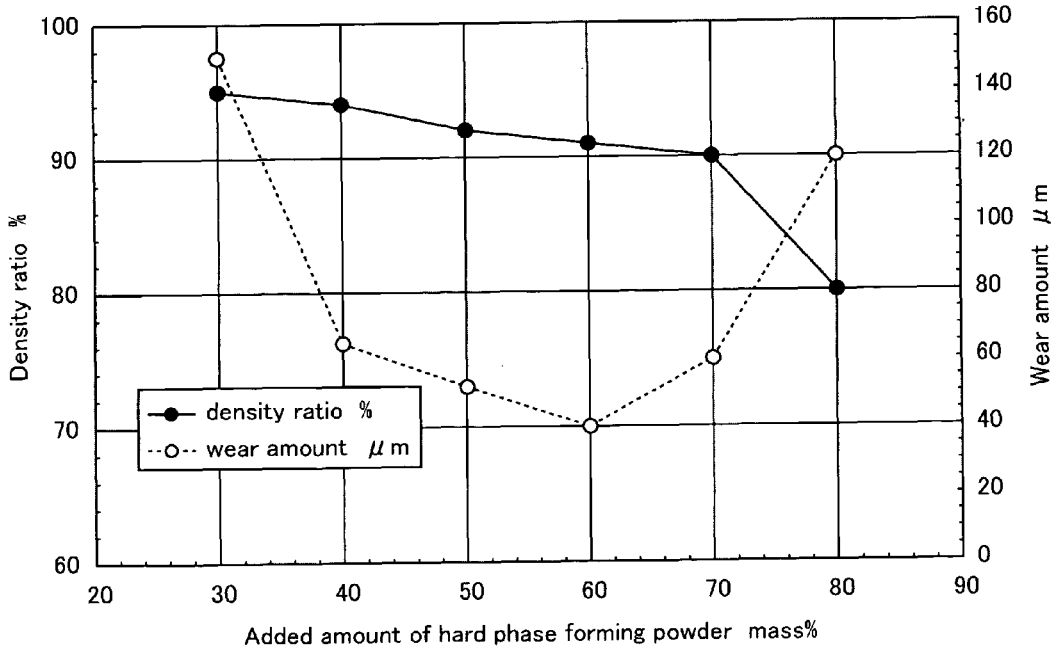
FIG. 2 is a graph showing the relationship of added amount of hard phase forming powder and density ratio and wear amount in the embodiments according to one aspect of the present invention.

As shown in FIG. 2, in the sample 06 of which the raw powder contained less than 40 mass % of the hard phase forming powder, the density ratio of the sample 06 was high, but the wear amount was large since the dispersion amount of the hard phase was small. On the other hand, when the mixed ratio of the hard phase forming powder in the raw powder of the sample was 40 mass % or more, the wear amount was reduced and wear resistance was improved. As the mixed ratio of the hard phase forming powder in the raw powder of the sample was increased, the density ratio decreased. In the sample 10 of which the raw powder contained more than 70 mass % of the hard phase forming powder, the density ratio greatly decreased, so that the strength of matrix and the wear resistance decreased and the wear amount increased. Thus, it was confirmed that the wear resistance was improved when the mixed ratio of the hard phase forming powder in the raw powder of the sample was 40 to 70 mass %.

Embodiment 3

The stainless steel powder used in the sample 02 of the embodiment 1 was prepared as a matrix forming powder and Co base alloy powders having compositions shown in Table 3 were prepared as hard phase forming powders. The stainless steel powder had the ratio of a particle diameter of 46 μm or less being 95%. Next, the matrix forming powder were mixed with 60 mass % of the hard phase forming powders, so that raw powders were obtained. The raw powders were compacted into green compacts and the green compacts were sintered in the same condition as in the embodiment 1, so that samples 11 to 16 were produced. The same tests as in the embodiment 1 were performed on the samples 11 to 16. The test results of the samples 11 to 16 and the test results of the sample 02 in the embodiment 1 are shown in Table 3 and FIG. 3.

Figure 3:
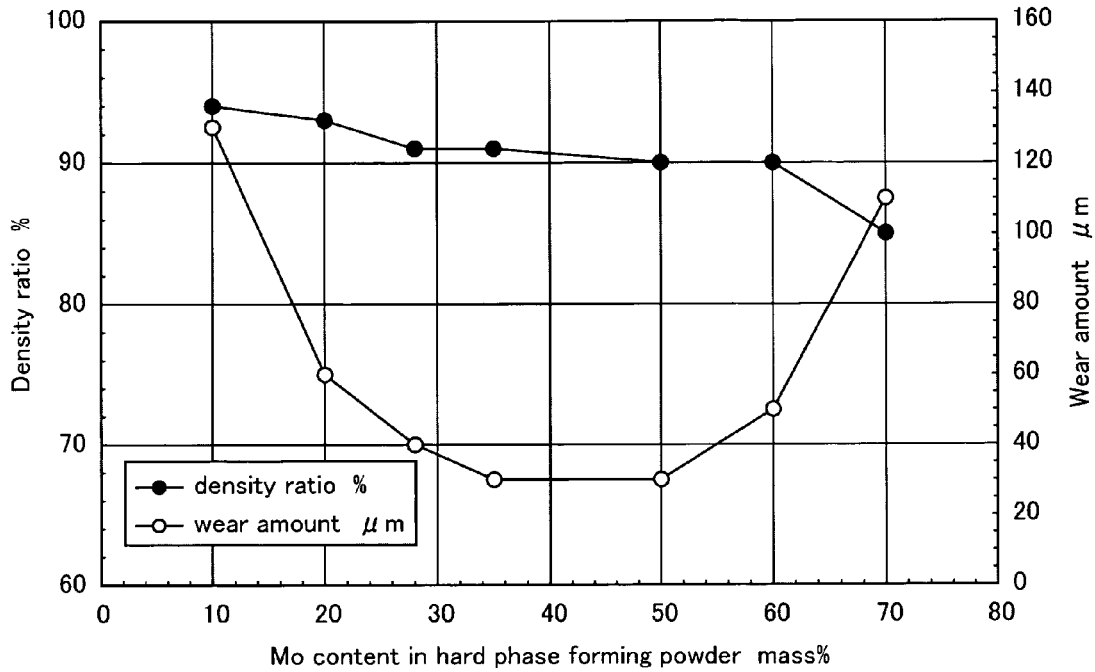
FIG. 3 is a graph showing the relationship of Mo content in hard phase forming powder and density ratio and wear amount in the embodiments according to one aspect of the present invention.
Figure 4A:
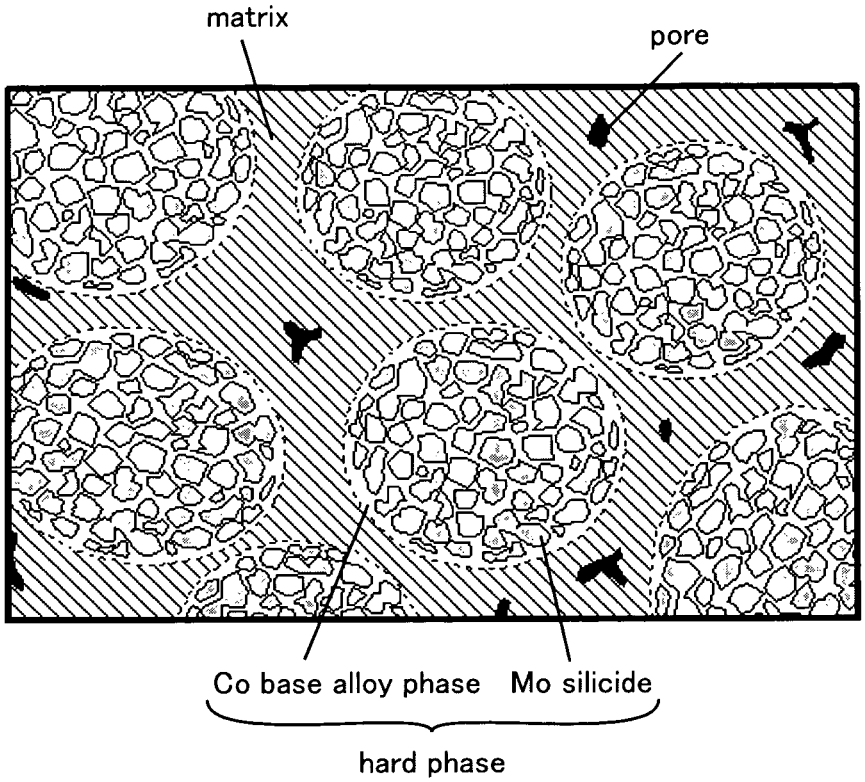
FIGS. 4A and 4B are schematic diagrams showing a metal structure of the first sintered valve seat according to another aspect of the present invention.
Figure 4B:
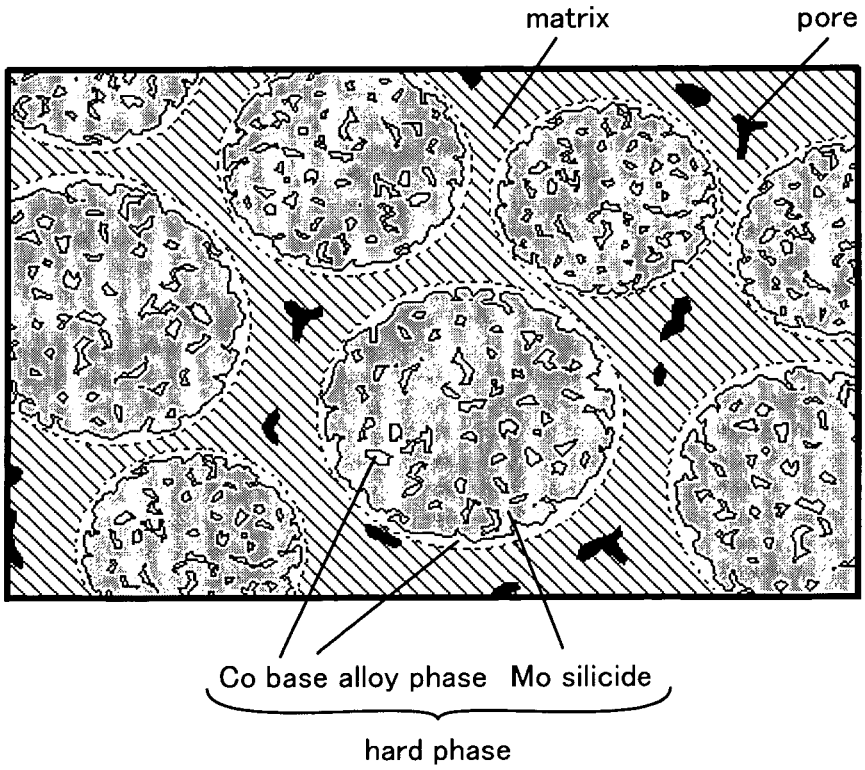
Figure 5A:
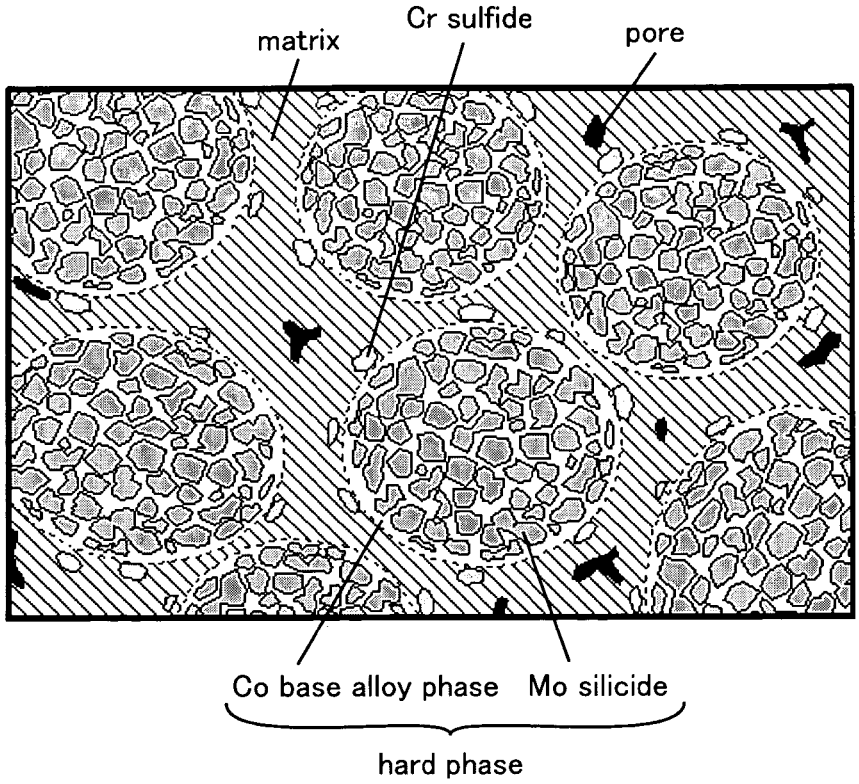
FIGS. 5A and 5B are schematic diagrams showing a metal structure of the second sintered valve seat according to another aspect of the present invention.
Figure 5B:
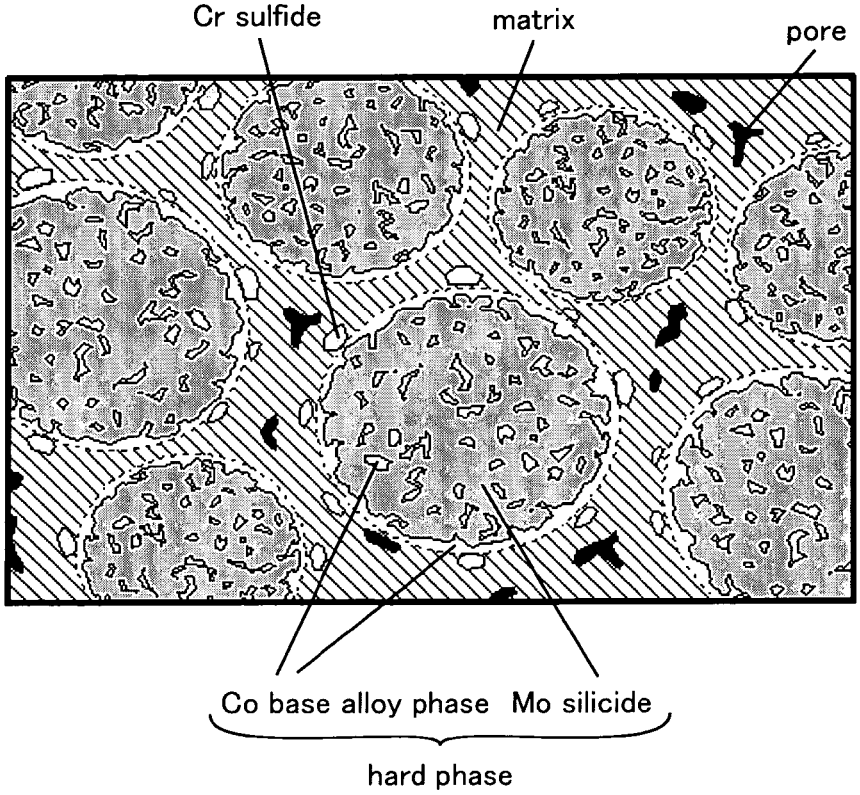
Figure 6A:
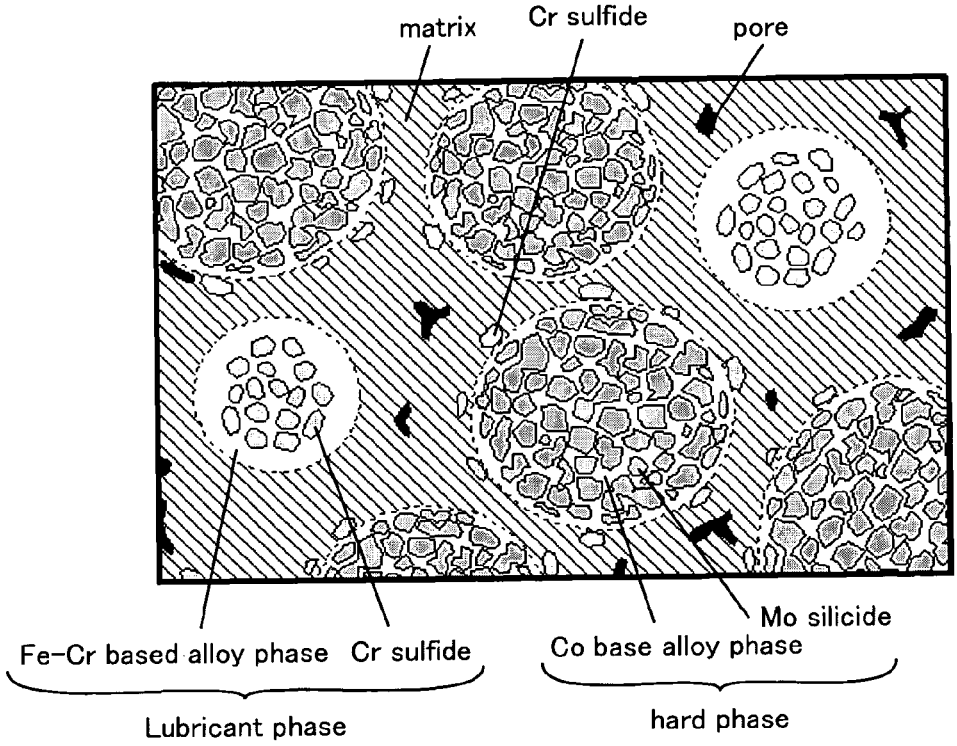
FIGS. 6A and 6B are schematic diagrams showing a metal structure of the third sintered valve seat according to another aspect of the present invention.
Figure 6B:
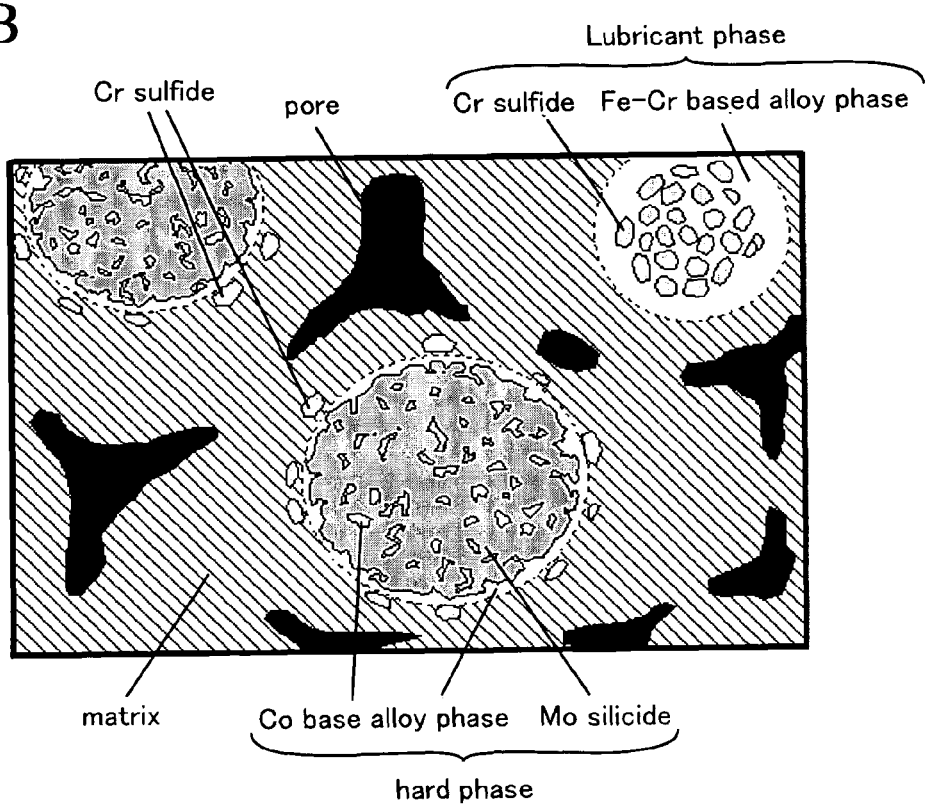
Figure 7:
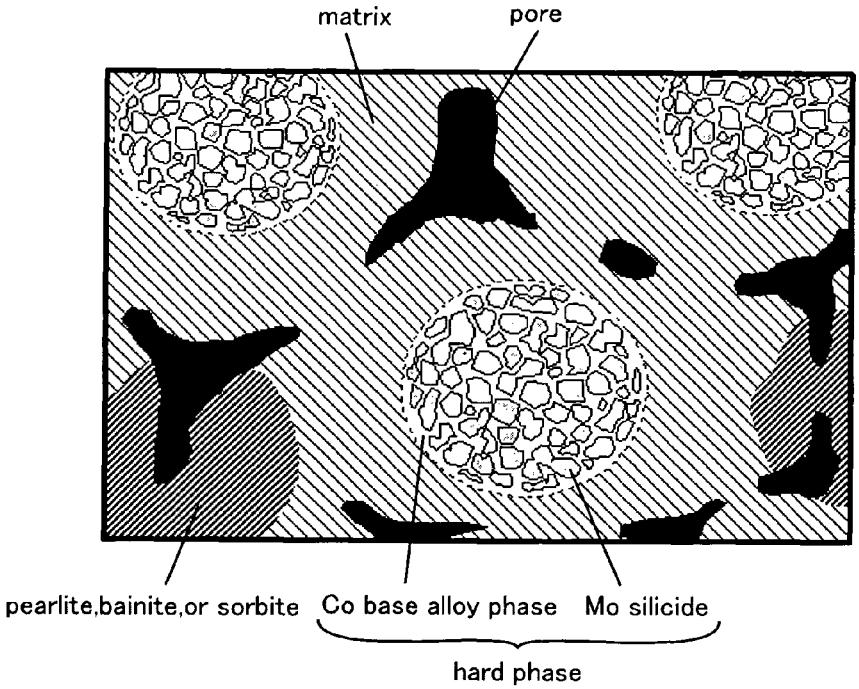
FIG. 7 is a schematic diagram showing a metal structure of the conventional sintered valve seat.

As shown in FIG. 3, in the sample 11 using the Co base alloy powder containing less than 20 mass % of Mo for forming the hard phase, since the precipitated amount of the Mo silicide was small, the wear amount was large. On the other hand, in the samples using the Co base alloy powder containing 20 mass % or more of Mo for forming the hard phase, as the Mo content was increased, the Mo silicide increased and the wear amount was reduced. As the Mo content in the Co base alloy powder was increased, the density ratio decreased. In the sample 16 using the Co base alloy powder containing more than 60 mass % for forming the hard phase, the density ratio was less than 90% and the wear amount rapidly increased. Thus, it was confirmed that when a Co—Mo—Si—Cr based alloy powder is used as a hard phase forming powder, the Mo content was 20 to 60 mass %.

Embodiment 4

The stainless steel powder used in the sample 03 of the embodiment 1 was prepared as a matrix forming powder and Co base alloy powders having compositions shown in Table 4 were prepared as hard phase forming powders. The stainless steel powder had the ratio of a particle diameter of 46 μm or less being 90%. Next, the matrix forming powder were mixed with 60 mass % of the hard phase forming powders, so that raw powders were obtained. The raw powders were compacted into green compacts and the green compacts were sintered in the same condition as in the embodiment 1, so that samples 17 to 23 were produced. The same tests as in the embodiment 1 were performed on the samples 17 to 23. The test results of the samples 17 to 23 and the test results of the sample 03 in the embodiment 1 are shown in Table 4.

TABLE 3

| | Mixing Ratio mass % | | | | | | | | |
|---|---|---|---|---|---|---|---|---|---|
| | | Hard Phase Forming Powder | | | | | Evaluation Item | | |
| Sample | Matrix Forming | | Composition mass % | | | | Density | Wear Amount | |
| No. | Powder | | Co | Mo | Si | Cr | Ratio % | μm | Note |
| 11 | Balance | 60 | Balance | 10 | 3 | 8 | 94 | 130 | Out of Lower Limit of Mo Content in Hard Phase Forming Powder |
| 12 | Balance | 60 | Balance | 20 | 3 | 8 | 93 | 60 | Lower Limit of Mo Content in Hard Phase Forming Powder |
| 02 | Balance | 60 | Balance | 28 | 3 | 8 | 91 | 40 | |
| 13 | Balance | 60 | Balance | 35 | 3 | 8 | 91 | 30 | |
| 14 | Balance | 60 | Balance | 50 | 3 | 9 | 90 | 30 | |
| 15 | Balance | 60 | Balance | 60 | 3 | 9 | 90 | 50 | Upper Limit of Mo Content in Hard Phase Forming Powder |
| 16 | Balance | 60 | Balance | 70 | 3 | 9 | 85 | 110 | Out of Upper Limit of Mo Content in Hard Phase Forming Powder |

TABLE 4

| Sample | Mixing Ratio mass % | | | | Wear Amount |
|---|---|---|---|---|---|
| | Matrix Forming Powder | | Hard Phase Forming Powder | | |
| No. | Composition | | Composition | Another Powder | μm |
| 03 | Balance | SUS316 | 60.0 Co—28Mo—2.5Si—8Cr | | 43 |
| 17 | Balance | SUS304 | 60.0 Co—28Mo—2.5Si—8Cr | | 45 |
| 18 | Balance | SUS310 | 60.0 Co—28Mo—2.5Si—8Cr | | 40 |
| 19 | Balance | SUS430 | 60.0 Co—28Mo—2.5Si—8Cr | | 50 |
| 20 | Balance | Fe | 60.0 Co—28Mo—2.5Si—8Cr | 1.5% of Cu powder<br>1% of Graphite Powder | 65 |
| 21 | Balance | Fe | 60.0 Co—28Mo—2.5Si—8Cr | 18% of Cu powder<br>0.8% of Graphite Powder | 60 |
| 22 | Balance | SUS316 | 60.0 Ni—10Cr—5Si—5Fe—2W—1C—0.5B | | 50 |
| 23 | Balance | SUS316 | 60.0 Fe—31Cr—5Ni—4C—2Si—1B | | 55 |

As shown in Table 4, even in a case in which the mixed ratio of the hard phase forming powder in the raw powder was 60 mass % which was large, when the ratio of particles having a particle diameter of 46 μm or less in the matrix forming powder was 90% or more, wear resistance could be good without depending on kinds of the matrix forming powder and the hard phase forming powder. Thus, it was confirmed that the effects of the present invention can be obtained.

Embodiment 5

Matrix forming powders and hard phase forming powders having compositions shown in Table 5 and were mixed at mixing ratios shown in Table 5, so that raw powders were obtained. The raw powders were compacted into green compacts at a compacting pressure of 800 MPa. The green compacts had a ring shape having an outer diameter of 30 mm, an inner diameter of 20 mm, and a height of 10 mm. Next, the green compacts were sintered at 1200° C. for 1 hour in a decomposed ammonia gas atmosphere, and the samples 01 to 19 were produced. Radial crushing strength tests and simplified wear tests were performed on the samples. The test results are shown in Table 6. The matrix forming powders had maximum particle diameters of 150 μm. The sample 19 was a conventional example using a powder having a conventional particle diameter distribution as a matrix forming powder.

The simplified wear tests were performed in the loaded state of striking and sliding at a high temperature. More specifically, the above sample was processed into a valve seat shape having a slope of 45 degrees at the inner side, and the sample was press-fitted into a housing made of an aluminum alloy. A disc-shaped contacting member (valve) with the valve seat was made from SUH-36 of JIS, and an outer surface thereof partially had a slope of 45 degrees. The valve was driven by motor, and vertical piston motions were caused by rotation of an eccentric cam, and sloped sides of the sample and contacting member were repeatedly contacted. That is, valve motions were repeated actions of releasing motion of departing from the valve seat by the eccentric cam rotated by motor driving, and contacting motion on the valve seat by the valve spring, and vertical piston motions were performed. In this test, the contacting member was heated by a burner and the temperature of the sample was set to a temperature of 350° C., and strike operations in the simplified wear test were 2800 times/minute, and the duration was 10 hours. In this manner, wear amount of the valve seats (samples) and the valves (contacting members) after the tests were measured and evaluated.

TABLE 5

| Sample | Mixing Ratio mass % | | | | | | | | | |
|---|---|---|---|---|---|---|---|---|---|---|
| | Matrix Forming Powder | | | | Hard Phase Forming Powder | | | | | |
| | | Particle diameter Distribution % | | | | Composition mass % | | | | |
| No. | Composition | 46 μm or less | 46 to74 μm | more than 74 μm | | Co | Mo | Si | Cr | Graphite Powder |
| 01 | Balance Fe—5Mo | 90 | 10 | — | 30 | Balance | 50 | 3 | 9 | 1.3 |
| 02 | Balance Fe—5Mo | 90 | 10 | — | 40 | Balance | 50 | 3 | 9 | 1.3 |
| 03 | Balance Fe—5Mo | 90 | 10 | — | 50 | Balance | 50 | 3 | 9 | 1.3 |
| 04 | Balance Fe—5Mo | 90 | 10 | — | 60 | Balance | 50 | 3 | 9 | 1.3 |
| 05 | Balance Fe—5Mo | 90 | 10 | — | 70 | Balance | 50 | 3 | 9 | 1.3 |
| 06 | Balance Fe—5Mo | 90 | 10 | — | 80 | Balance | 50 | 3 | 9 | 1.3 |
| 07 | Balance Fe—5Mo | 90 | 10 | — | 50 | Balance | 10 | 3 | 9 | 1.3 |
| 08 | Balance Fe—5Mo | 90 | 10 | — | 50 | Balance | 20 | 3 | 9 | 1.3 |
| 09 | Balance Fe—5Mo | 90 | 10 | — | 50 | Balance | 30 | 3 | 9 | 1.3 |
| 10 | Balance Fe—5Mo | 90 | 10 | — | 50 | Balance | 60 | 3 | 9 | 1.3 |
| 11 | Balance Fe—5Mo | 90 | 10 | — | 50 | Balance | 70 | 3 | 9 | 1.3 |
| 12 | Balance Fe—5Mo | 80 | 20 | — | 50 | Balance | 50 | 3 | 9 | 1.3 |
| 13 | Balance Fe—5Mo | 70 | 30 | — | 50 | Balance | 50 | 3 | 9 | 1.3 |

TABLE 5-continued

| Sample No. | Mixing Ratio mass % | | | | | | | | | |
|---|---|---|---|---|---|---|---|---|---|---|
| | Matrix Forming Powder | | | | | | | | | |
| | | Particle diameter Distribution % | | | | Hard Phase Forming Powder | | | | |
| | | 46 μm or less | 46 to74 μm | more than 74 μm | | Composition mass % | | | | Graphite Powder |
| | Composition | | | | | Co | Mo | Si | Cr | |
| 14 | Balance Fe—5Mo | 60 | 20 | 20 | 50 | Balance | 50 | 3 | 9 | 1.3 |
| 15 | Balance Fe—3Cr—0.3Mo—0.3V | 90 | 10 | — | 50 | Balance | 50 | 3 | 9 | 1.3 |
| 16 | Balance Fe—6.5Co—1.5Mo—1.5Ni | 90 | 10 | — | 50 | Balance | 50 | 3 | 9 | 1.3 |
| 17 | Balance Fe—3Cr—0.3Mo—0.3V: 50<br>Fe—6.5Co—1.5Mo—1.5Ni: 50 | 90 | 10 | — | 50 | Balance | 50 | 3 | 9 | 1.3 |
| 18 | Balance Fe—4Ni—1.5Cu—0.5Mo# | 90 | 10 | — | 50 | Balance | 50 | 3 | 9 | 1.3 |
| 19 | Balance Fe—5Mo | 10 | 20 | 70 | 50 | Balance | 50 | 3 | 9 | 1.3 |

In Table 5, reference symbol # denotes a partially diffusion bonding alloy powder.

TABLE 6

| Sample No. | Evaluation Item | | | | |
|---|---|---|---|---|---|
| | Radial Crushing Strength MPa | Wear Amount μm | | | Note |
| | | Valve Seat | Valve | Total | |
| 01 | 640 | 151 | 11 | 162 | Out of Lower Limit of Added Amount of Hard Phase Forming Powder |
| 02 | 580 | 85 | 8 | 93 | Lower Limit of Added Amount of Hard Phase Forming Powder |
| 03 | 520 | 70 | 10 | 80 | |
| 04 | 460 | 63 | 15 | 78 | |
| 05 | 400 | 84 | 19 | 103 | Upper Limit of Added Amount of Hard Phase Forming Powder |
| 06 | 340 | 121 | 60 | 181 | Out of Upper Limit of Added Amount of Hard Phase Forming Powder |
| 07 | 620 | 250 | 5 | 255 | Out of Lower Limit of Mo Content in Hard Phase Forming Powder |
| 08 | 570 | 94 | 0 | 94 | Lower Limit of Mo Content in Hard Phase Forming Powder |
| 09 | 550 | 86 | 0 | 86 | |
| 10 | 500 | 75 | 14 | 89 | Upper Limit of Mo Content in Hard Phase Forming Powder |
| 11 | 420 | 130 | 40 | 170 | More Than Upper Limit of Mo Content in Hard Phase Forming Powder |
| 12 | 510 | 72 | 10 | 82 | |
| 13 | 500 | 75 | 10 | 85 | |
| 14 | 450 | 130 | 16 | 146 | Out of Range of Particle diameter Distribution of Matrix Forming Powder |
| 15 | 600 | 80 | 10 | 90 | |
| 16 | 550 | 80 | 5 | 85 | |
| 17 | 510 | 85 | 10 | 95 | |
| 18 | 540 | 92 | 12 | 104 | |
| 19 | 280 | 210 | 40 | 250 | Conventional Example |

Figure 8:
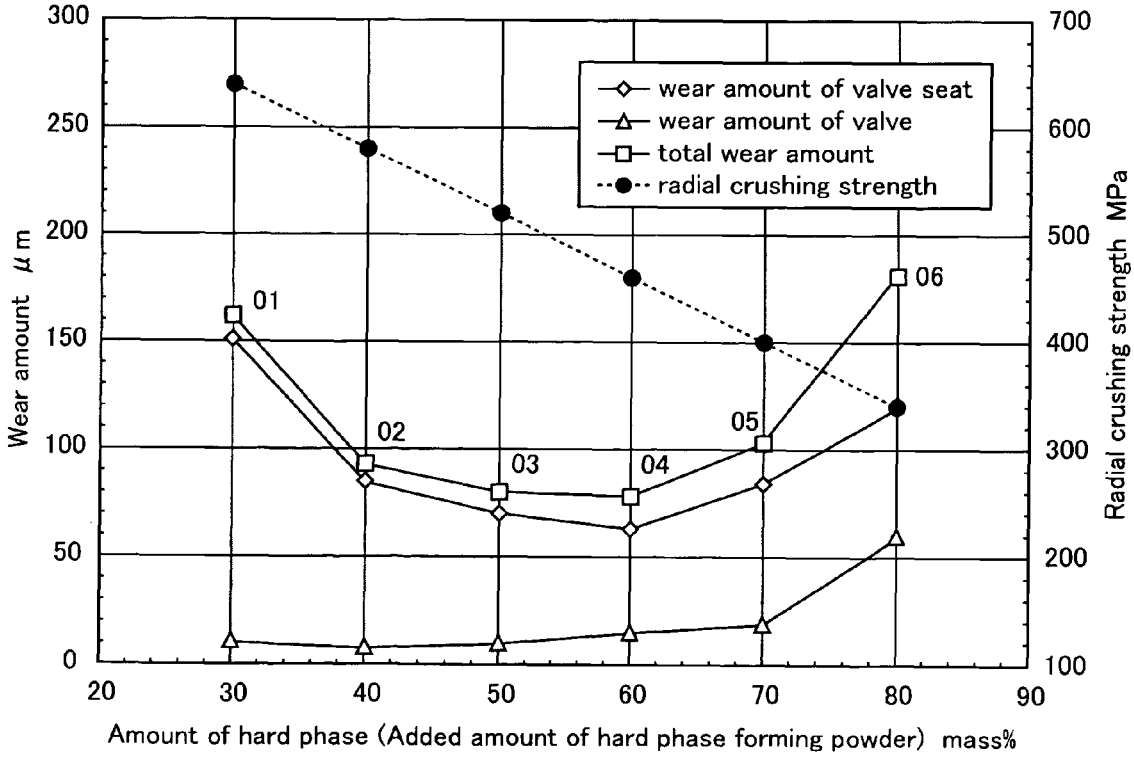
FIG. 8 is a graph showing the relationship of amount of hard phase and wear amount in the embodiments according to another aspect of the present invention.

The relationship between the amount of the hard phase in the matrix (the mixed amount of the hard phase forming powder) and the wear amount was examined by comparing the samples 01 to 06 shown in Tables 5 and 6. The examined results are shown in FIG. 8. It should be noted that reference numerals in the Figure denote sample numbers. As shown in FIG. 8, in the sample 01 containing less than 40 mass % of hard phase dispersed in matrix, the wear resistance was insufficient and the wear amount of the valve seat was large. On the other hand, in the sample 02 containing 40 mass % of hard phase dispersed in matrix, the wear resistance was improved and the wear amount of the valve seat was reduced. As the amount of hard phase increased, the wear resistance was improved and the wear amount of the valve seat was reduced, but the wear amount of the valve gradually increased. In addition, the compressibility of the raw powder decreased by increase in the amount of hard phase, so that the strength of matrix (strength of radial crushing strength) decreased. Due to this, in the sample 05 containing 70 mass % of hard phase dispersed in matrix, the strength of the valve seat decreased, so that the wear amount of the valve seat inversely increased. It should be noted that in the sample 05 containing 70 mass % of hard phase dispersed in matrix, the total wear amount was allowable. However, in the sample 06 containing 70 or more mass % of hard phase dispersed in matrix, the influence of the decrease of the valve seat in the wear resistance was large by the decrease of matrix in strength (decrease in radial crushing strength), so that the wear amount of the valve seat greatly increased. In addition, since abrasion powder of the valve seat worked as abrasive particles, the wear amount of the valve increased, so that total amount of the wear amount greatly increased. Thus, it was confirmed that the wear resistance can be improved when the amount of hard phase dispersed in matrix is 40 to 70 mass %.

Figure 9:
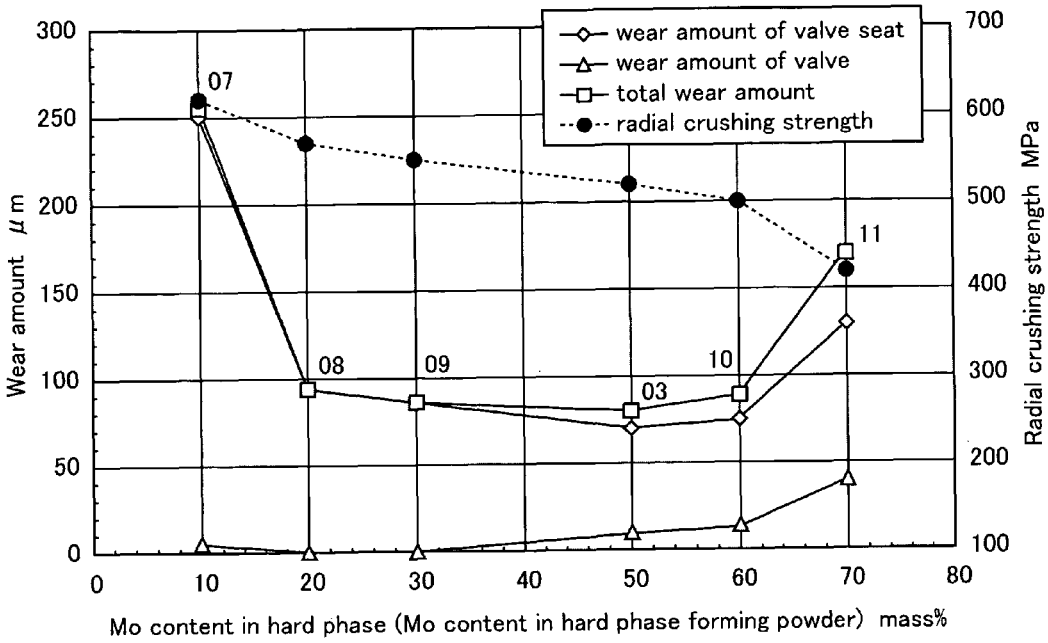
FIG. 9 is a graph showing the relationship of Mo content in hard phase and wear amount in the embodiments according to another aspect of the present invention.

The relationship between the Mo content in hard phase (the Mo content in the hard phase forming powder) and the wear amount was examined by comparing the samples 03 and 07 to 11 shown in Tables 5 and 6. The examined results are shown in FIG. 9. As shown in FIG. 9, in the sample 07 containing less than 20 mass % of Mo in hard phase, since the amount of Mo silicide precipitated in the hard phase was small, the wear resistance was low, so that the wear amount of the valve seat was large. On the other hand, in the sample 08 containing 20 mass % of Mo in hard phase, Mo silicide was sufficiently precipitated and the wear amount of the valve seat was reduced. As the Mo content in hard phase increased, the precipitated amount of Mo silicide increased, so that the wear amount of the valve seat was reduced. However, the amount of hard Mo silicide increased, the wear amount of the valve which is a contacting member gradually increased when the Mo content in hard phase exceeded 20 mass %. In addition, as the Mo content in hard phase increased, the strength of matrix (the radial crushing strength) decreased. In particular, in the sample 11 containing more than 60 mass % in hard phase, the strength of matrix (the radial crushing strength) greatly decreased. In the sample 11 containing more than 60 mass % in hard phase, the wear resistance decreased by the decrease in the strength of matrix, so that the wear amount of the valve seat greatly increased. In addition, abrasion powder of the valve seat worked as abrasive particles, so that the wear amount of the valve increased. As a result, the wear amount of the valve increased and the total wear amount greatly increased. Thus, it was confirmed that the wear resistance is improved when the Mo content in hard phase is 20 to 60 mass %.

Figure 10:
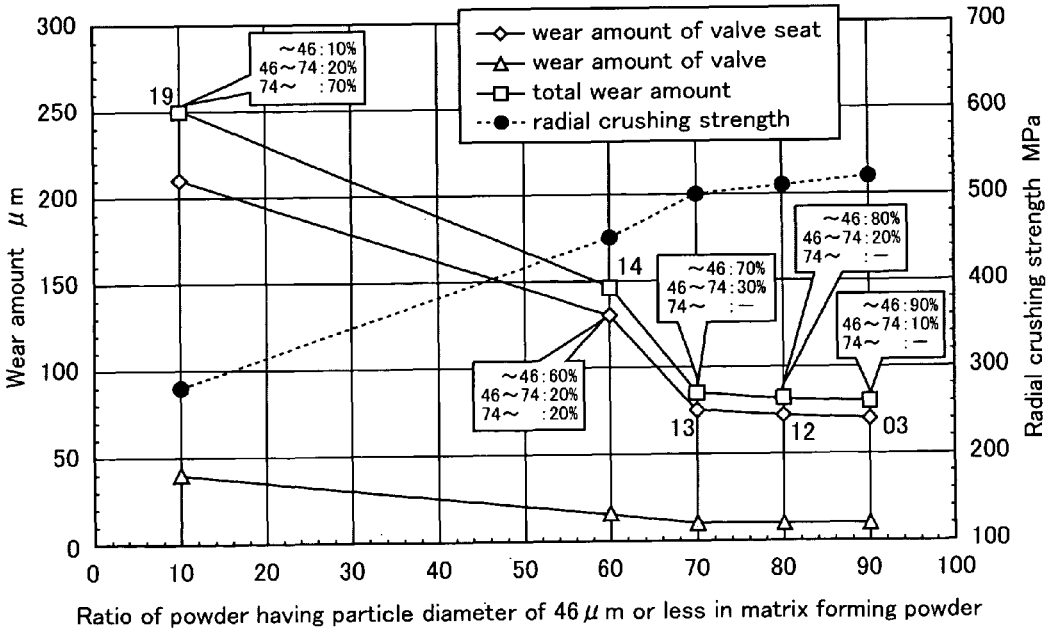
FIG. 10 is a graph showing the relationship of particle diameter distribution of matrix forming powder and wear amount in the embodiments according to another aspect of the present invention.

The relationship between the Mo content in hard phase (the Mo content in the hard phase forming powder) and the wear amount was examined by comparing the samples 03, 12 to 14 and 19 shown in Tables 5 and 6. The examined results are shown in FIG. 10. As shown in FIG. 10, in the samples 03, 12 and 13 which does not contain particles having a particle diameter of more than 74 μm, densification of matrix by the sintering was performed, so that the strength of matrix was improved and the wear resistance was improved. On the other hand, in the sample 14 containing particles having a particle diameter of more than 74 μm, densification of matrix by the sintering was insufficiently performed, so that the strength of matrix was not improved and the wear resistance was insufficient. In addition, in the sample 19 (conventional example) of which the matrix forming powder having a particle diameter distribution such that particles having a particle diameter of more than 74 μm occupied most of the matrix forming powder, the strength of matrix (the radial crushing strength) and the wear resistance decreased. Thus, it was confirmed that even when the amount of hard phase is large, the valve seat is superior in matrix strength and wear resistance by using a powder having a maximum particle diameter of 74 μm or less as a matrix forming powder.

In comparison with the samples 03, 12 and 13 using the matrix forming powder having a particle diameter of 74 μm or less, as the ratio of particles having a particle diameter of 46 μm or less in the matrix forming powder increased, the radial crushing strength was improved. The sample 03 using the matrix forming powder containing 90% of particles having a maximum particle diameter of 46 μm or less exhibited the high radial crushing strength. Thus, it was confirmed that the matrix forming powder more desirably has 90% or more of particles having a maximum particle diameter of 46 μm or less and the balance of particles a maximum particle diameter of 74 μm or less.

Figure 16:
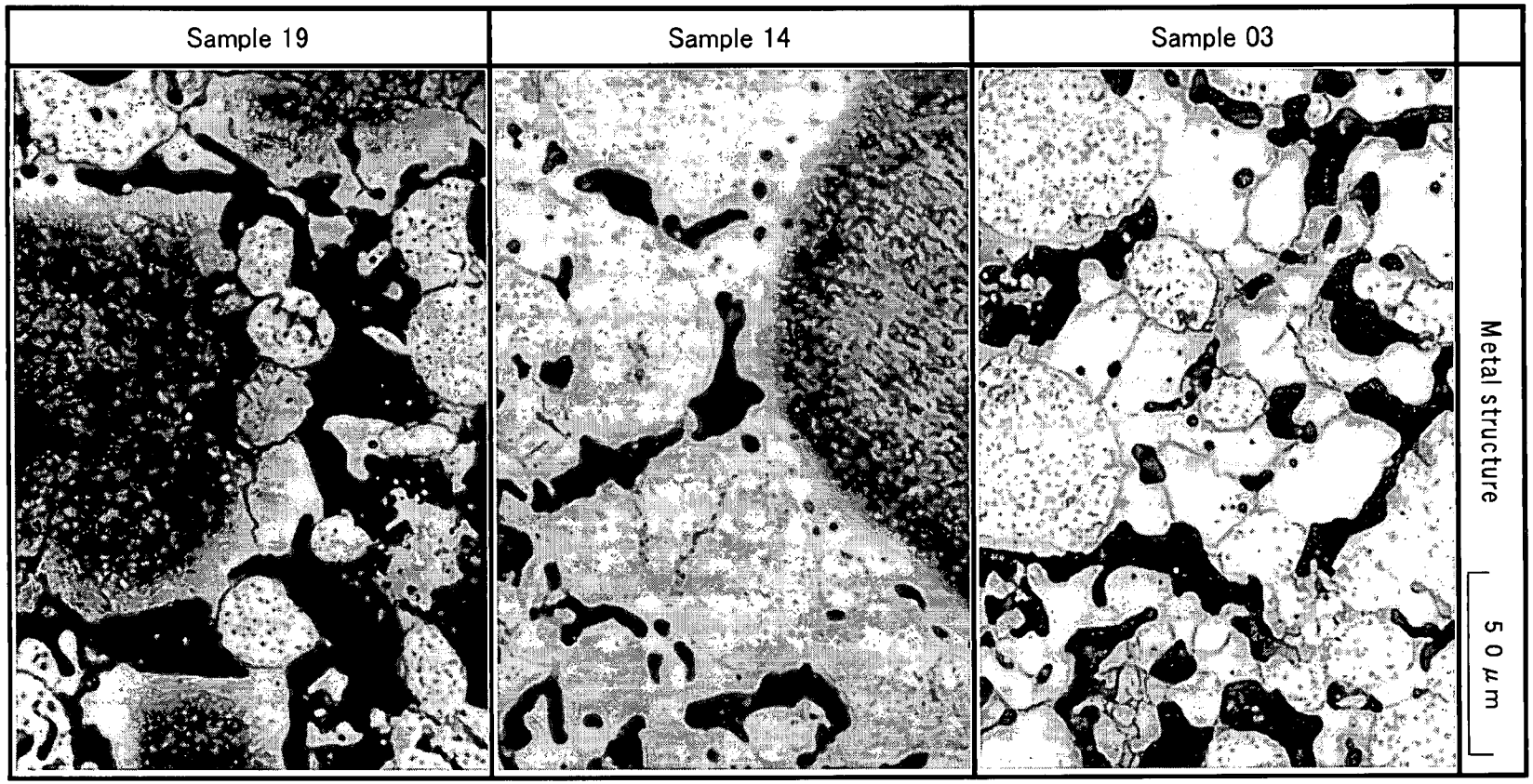
FIG. 16 shows images of metal structures of the example (the first sintered valve seat) according to another aspect of the present invention, of the comparative example, and of the conventional example.

FIG. 16 are images showing metal structures of the sample 03 (the example of the present invention), the sample 14 (the comparative example), and the sample 19 (the conventional example), the metal structures corroded by using 5% of nitric acid ethanol. As shown in FIG. 16, in the sample 03 (the example of the present invention), pearlite, sorbite, bainite and the like were not observed in matrix structure, and only white phase formed by element diffusion from hard phase was observed therein. On the other hand, in the sample 14 (the comparative example), portions in which sorbite and bainite remained were observed in matrix portion formed by large powder. Due to this, it is conceived that in the sample 14, the strength of matrix and the wear resistance decreased. In the sample 19 (the conventional example), most portions of matrix structure were sorbite and bainite, and densification was not performed in the sintering, so that the amount of pores was large. Due to these, it was conceived that the strength of matrix and the wear resistance decreased.

Figure 11:
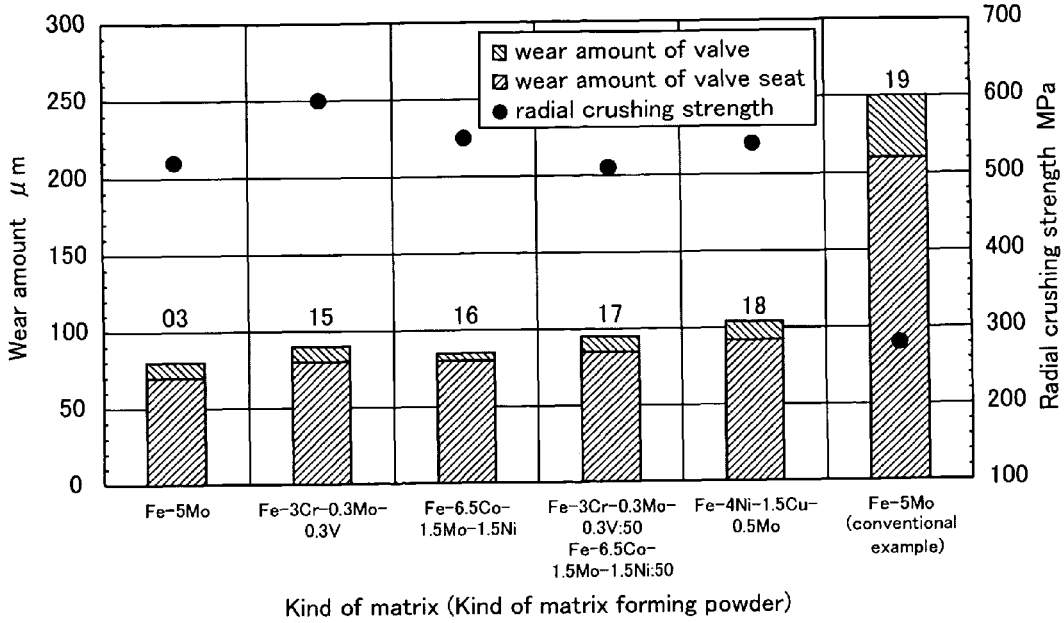
FIG. 11 is a graph showing the relationship of kind of matrix and wear amount in the embodiments according to another aspect of the present invention.

The relationship between the kind of the matrix (the kind of matrix forming powder) and the wear amount was examined by comparing the samples 03 and 15 to 18 shown in Tables 5 and 6. The examined results are shown in FIG. 11. As shown in FIG. 11, when the mixing ratio of the hard phase forming powder in the raw powder was 50 mass % which was large and powder having a maximum particle diameter of 74 μm or less was used as a matrix forming powder, wear resistance was good without depending on the kind of the matrix forming powder. The total wear amount of the sample using an Fe-5Mo steel powder as a matrix forming powder was the smallest of those of these samples although the sample using an Fe-5Mo steel powder was slightly different from them. Therefore, the sample using an Fe-5Mo steel powder was good.

Embodiment 6

The matrix forming powder (the Fe-5Mo powder having 90% of particles having a maximum particle diameter of 46 μm or less and the balance of particles a maximum particle diameter which was more than 46 and not more than 74 μm) and the hard phase forming powder (the Co-50Mo-3Si-9Cr alloy powder having a maximum particle diameter of 150 μm) which were used in the sample 03 in the embodiment 5 were prepared. In addition, a molybdenum disulfide powder, a tungsten disulfide powder, an iron sulfide powder, a copper sulfide powder and a manganese sulfide were prepared. These powders were mixed at mixing ratios shown in Table 7, so that raw powders were obtained. The raw powders were compacted into green compacts and the green compacts were sintered in the same condition of the embodiment 5, so that samples 20 to 29 were produced. Tests of radial crushing strength and simplified wear tests were performed on the samples 20 to 29. The test results of the samples 20 to 29 are shown together with the test result of the sample 03 of the embodiment 1 in Table 8.

TABLE 7

| Sample No. | Mixing Ratio mass % Matrix Forming Powder | Hard Phase Forming Powder | Sulfide Powder | | Graphite Powder | Note |
|---|---|---|---|---|---|---|
| | | | | Kind | | |
| 03 | Balance | 50 | — | — | 1.3 | |
| 20 | Balance | 50 | 0.1 | $MoS_2$ | 1.3 | S content was 0.04 mass %. |
| 21 | Balance | 50 | 0.5 | $MoS_2$ | 1.3 | S content was 0.20 mass %. |
| 22 | Balance | 50 | 2.0 | $MoS_2$ | 1.3 | S content was 0.79 mass %. |
| 23 | Balance | 50 | 5.0 | $MoS_2$ | 1.3 | S content was 1.98 mass %. |
| 24 | Balance | 50 | 12.65 | $MoS_2$ | 1.3 | S content was 5.00 mass %. |
| 25 | Balance | 50 | 15.0 | $MoS_2$ | 1.3 | S content was 5.93 mass %. Out of Upper Limit of Sulfide Powder |
| 26 | Balance | 50 | 2.0 | $WS_2$ | 1.3 | |
| 27 | Balance | 50 | 2.0 | FeS | 1.3 | |
| 28 | Balance | 50 | 2.0 | CuS | 1.3 | |
| 29 | Balance | 50 | 2.0 | MnS | 1.3 | CrS was not dispersed. |
| 19 | Balance | 50 | — | — | 1.3 | Conventional Example |

TABLE 8

| Sample No. | Evaluation Item Radial Crushing Strength MPa | Wear Amount μm Valve Seat | Valve | Total | Note |
|---|---|---|---|---|---|
| 03 | 520 | 70 | 10 | 80 | |
| 20 | 520 | 70 | 10 | 80 | S content was 0.04 mass %. |
| 21 | 500 | 64 | 5 | 69 | S content was 0.20 mass %. |
| 22 | 441 | 50 | 0 | 50 | S content was 0.79 mass % |
| 23 | 420 | 52 | 5 | 57 | S content was 1.98 mass % |
| 24 | 360 | 71 | 10 | 81 | S content was 5.00 mass % |
| 25 | 290 | 150 | 20 | 170 | S content was 5.93 mass %. Out of Upper Limit Amount of Sulfide Powder |
| 26 | 440 | 55 | 5 | 60 | |
| 27 | 420 | 65 | 5 | 70 | |
| 28 | 450 | 60 | 10 | 70 | |
| 29 | 430 | 85 | 10 | 95 | CrS was not dispersed. |
| 19 | 280 | 210 | 40 | 250 | Conventional Example |

Figure 12:
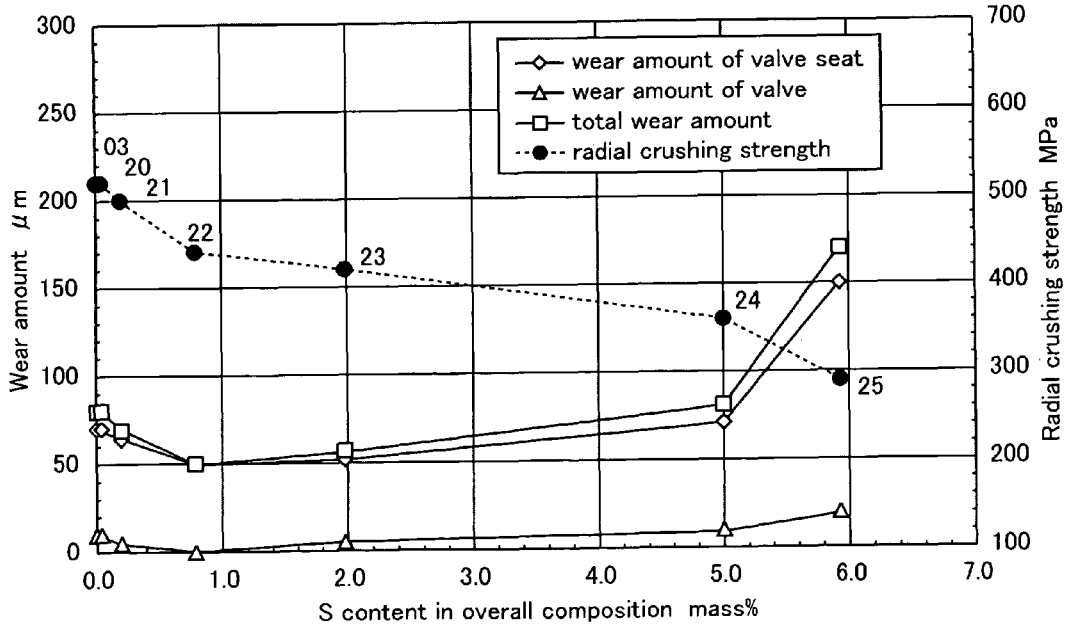
FIG. 12 is a graph showing the relationship of S content in overall composition and wear amount in the embodiments according to another aspect of the present invention.

The relationship between the mixed amount of the sulfide powder and amount was examined by comparing the samples 03, 20 to 25 shown in and 8. The examined results are shown in FIG. 12. As shown in FIG. 12, the sulfide powder was added to the first sintered valve seat (the sample 03) such that the S content in the overall composition was 5.0 mass % or less, so that the wear resistance was greatly improved. In particular, when the S content in the overall composition was 0.8 mass % (which corresponded to the sample 22) to 2 mass % (which corresponded to the sample 25), the wear resistance was more greatly improved. As the mixed amount of the sulfide powder was increased, the radial crushing strength decreased. In particular, when the S content in the overall composition exceeded 5.0 mass % (which corresponded to the sample 25), the influence of the decrease in the strength of matrix was great, so that the wear resistance decreased all the more.

Figure 17:
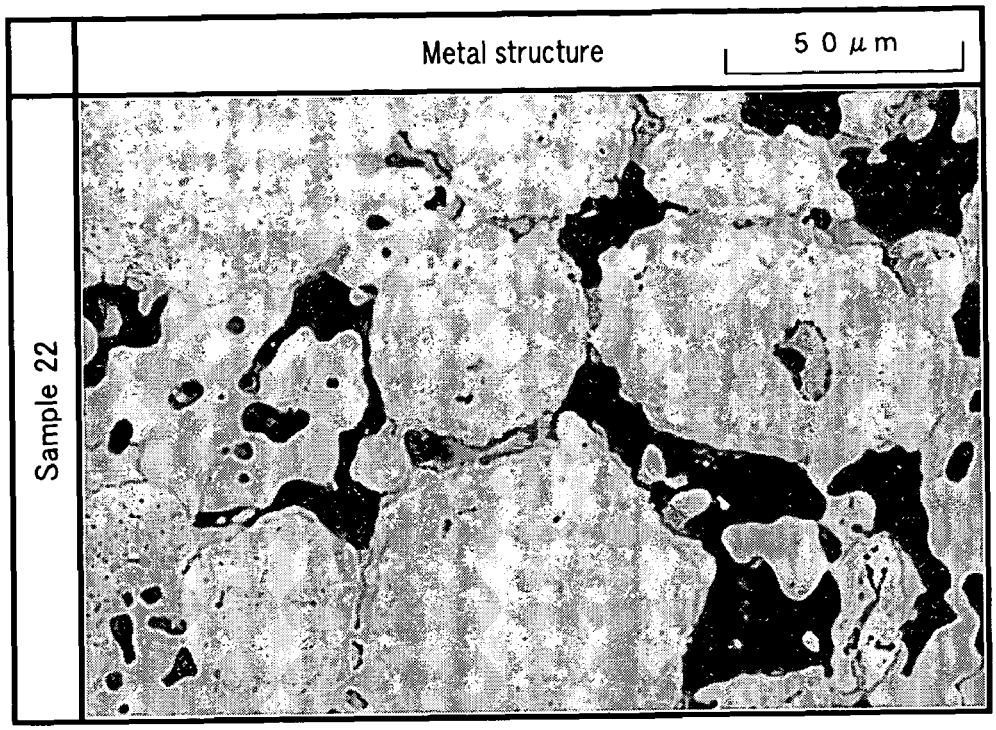
FIG. 17 shows images of metal structures of the second sintered valve seat according to another aspect of the present invention.

FIG. 17 is an image showing a metal structure of the sample 22, the metal structure corroded by using 5% of nitric acid ethanol. As shown in FIG. 17, gray structures dispersed around the hard phase were observed. The gray structures were analyzed by EPMA. As a result, since Cr and S coexisted were observed, it was conceived that the gray structures were Cr sulfides. Since the molybdenum disulfide powder which was supplied as an S supply was not detected, it was conceived that all of the molybdenum disulfide powder was decomposed. Therefore, it was conceived that the Cr sulfides (gray structures) was formed such that S generated by decomposing the molybdenum disulfide was bonded with Cr and was precipitated in the matrix.

Figure 13:
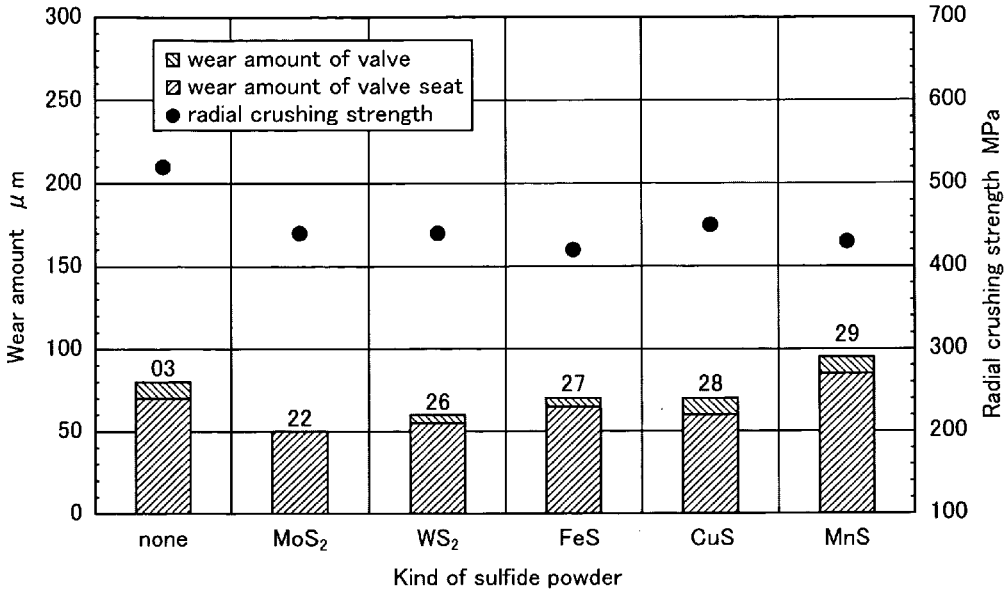
FIG. 13 is a graph showing the relationship of kind of sulfide powder and wear amount in the embodiments according to another aspect of the present invention.

The relationship between the kind of the sulfide powder and the wear amount was examined by comparing the samples 03, 22, and 26 to 29 shown in Tables 7 and 8. The examined results are shown in FIG. 13. As shown in FIG. 13, the radial crushing strength decreased by adding the sulfide powder without depending on the kind of the sulfide powder. On the other hand, in cases in which the molybdenum disulfide powder, the tungsten disulfide powder, the iron sulfide powder, the copper sulfide powder were used as a sulfide powder, the wear amount of these cases was smaller than that of the sample 03 to which a sulfide powder was added. However, in a case in which the manganese sulfide was used as a sulfide powder, the wear amount increased all the more. This reason is thought as follows. That is, the molybdenum disulfide powder, the tungsten disulfide powder, the iron sulfide powder, the copper sulfide powder were decomposed in the sintering and Cr sulfide was generated, so that wear resistance was improved. However, since the manganese sulfide was not decomposed, the wear resistance decreased all the more by the influence of the decrease in the strength of matrix.

Embodiment 7

The matrix forming powder (the Fe-5Mo powder having 90% of particles having a maximum particle diameter of 46 μm or less and the balance of particles a maximum particle diameter which was more than 46 and not more than 74 μm) and the hard phase forming powder (the Co-50Mo-3Si-9Cr alloy powder having a maximum particle diameter of 150 μm) which were used in the sample 03 in the embodiment 5 were prepared. A molybdenum disulfide powder was prepared as a sulfide powder. A Cr contained steel powder having a composition shown in Table 9 was prepared as a lubricant phase forming powder. These powders were mixed at mixing ratios shown in Table 9, so that raw powders were obtained. The raw powders were compacted into green compacts and the green compacts were sintered in the same condition of the embodiment 1, so that samples 30 to 36 were produced. Tests of radial crushing length and simplified wear tests were performed on the samples 30 to 36. The test results of the samples 20 to 29 are shown together with the test results of the sample 03 of the embodiment 1 and the sample 22 of the embodiment 6 in Table 10.

TABLE 9

| Sample No. | Mixing Ratio mass % | | | | | |
|---|---|---|---|---|---|---|
| | Matrix Forming Powder | Hard Phase Forming Powder | Sulfide Powder | Lubricant Phase Forming Powder | | Graphite Powder |
| | | | | | Composition | |
| 03 | Balance | 50 | — | — | | 1.3 |
| 22 | Balance | 50 | 2.0 | — | | 1.3 |
| 30 | Balance | 50 | 2.0 | 5 | Fe—12Cr—1Mo—0.5V—1.4C | 1.3 |
| 31 | Balance | 50 | 2.0 | 10 | Fe—12Cr—1Mo—0.5V—1.4C | 1.3 |
| 32 | Balance | 50 | 2.0 | 20 | Fe—12Cr—1Mo—0.5V—1.4C | 1.3 |
| 33 | Balance | 50 | 2.0 | 25 | Fe—12Cr—1Mo—0.5V—1.4C | 1.3 |
| 34 | Balance | 50 | 2.0 | 10 | Fe—12Cr | 1.3 |
| 35 | Balance | 50 | 2.0 | 10 | Fe—18Cr—8Ni | 1.3 |
| 36 | Balance | 50 | 2.0 | 10 | Fe—4Cr—5Mo—2V—6W—1C | 1.3 |
| 19 | Balance | 50 | — | — | | 1.3 |

TABLE 10

| Sample No. | Evaluation Item | | | | |
|---|---|---|---|---|---|
| | Radial Crushing Strength MPa | Wear Amount μm | | | Note |
| | | Valve Seat | Valve | Total | |
| 03 | 520 | 70 | 10 | 80 | |
| 22 | 441 | 50 | 0 | 50 | |
| 30 | 440 | 40 | 0 | 40 | |
| 31 | 438 | 40 | 0 | 40 | |
| 32 | 400 | 45 | 5 | 50 | |
| 33 | 280 | 110 | 30 | 140 | Out of Upper Limit Amount of Lubricant Phase Forming Powder |
| 34 | 432 | 42 | 0 | 42 | |
| 35 | 430 | 45 | 0 | 45 | |
| 36 | 422 | 46 | 0 | 46 | |
| 19 | 280 | 210 | 40 | 250 | Conventional Example |

Figure 14:
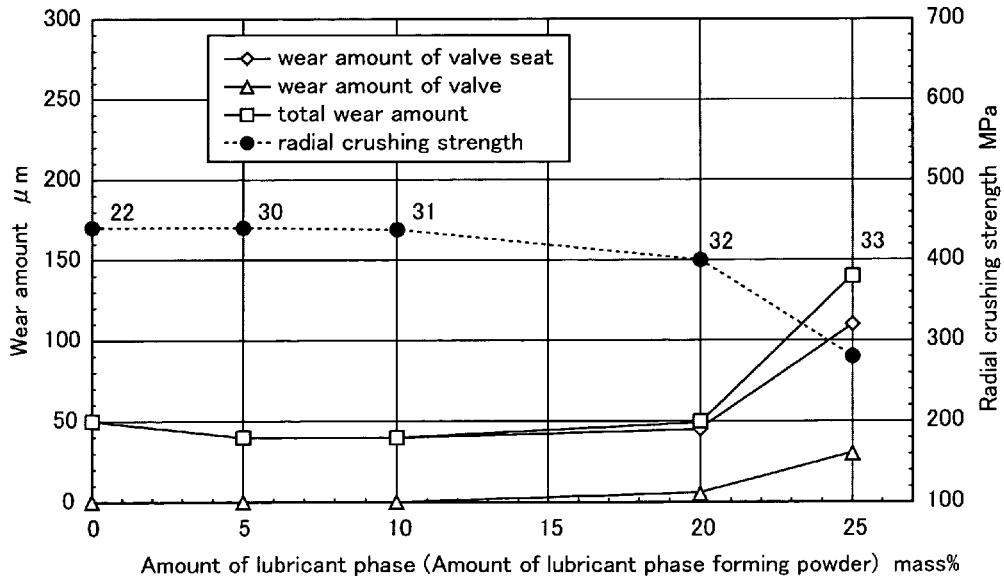
FIG. 14 is a graph showing the relationship of amount of lubricant phase and wear amount in the embodiments according to another aspect of the present invention.

The relationship between the amount of lubricant phase (the mixed amount of the lubricant phase forming powder) and the wear amount was examined by comparing the samples 22, and 30 to 33 shown in Tables 9 and 10. The examined results are shown in FIG. 14. As shown in FIG. 14, the lubricant phase was dispersed more in the matrix, so that the wear resistance was improved more. In particular, when the dispersed amount of the lubricant phase was 3 (which corresponded to the sample 30) to 10 mass % (which corresponded to the sample 31), the wear resistance was greatly improved. When the dispersed amount of the lubricant phase exceeded 10 mass %, the radial crushing strength decreased. In particular, when the lubricant phase forming powder was mixed (in the sample 33) such that the dispersed amount of the lubricant phase exceeded 20 mass %, the influence of the decrease in the strength of matrix was large, so that the wear resistance inversely decreased.

Figure 18:
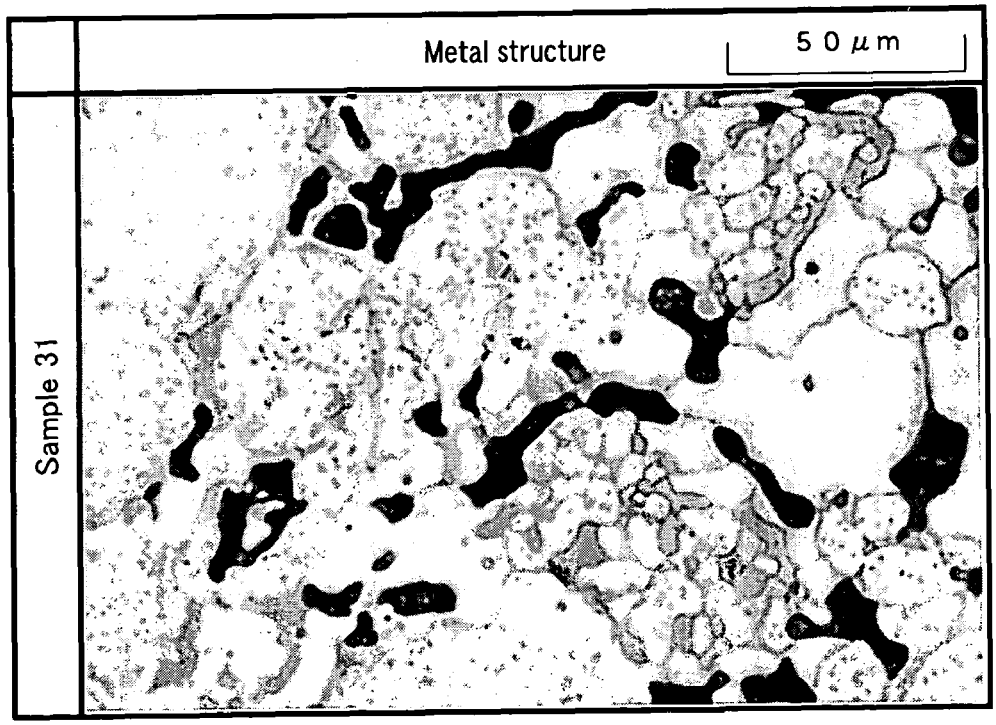
FIG. 18 shows images of metal structures of the third sintered valve seat according to another aspect of the present invention.

FIG. 18 is an image showing a metal structure of the sample 31, the metal structure corroded by using 5% of nitric acid ethanol. As shown in FIG. 18, it was observed that gray particles which were different from the hard phase and were precipitated and gathered were dispersed in the matrix. The gray particles were analyzed by EPMA. As a result, since Cr and S coexisted were observed, it was conceived that the gray particles were Cr sulfides. The phase (lubricant phase) in which Cr sulfides were precipitated and gathered was dispersed in the matrix, so that the wear resistance was improved as described above.

Figure 15:
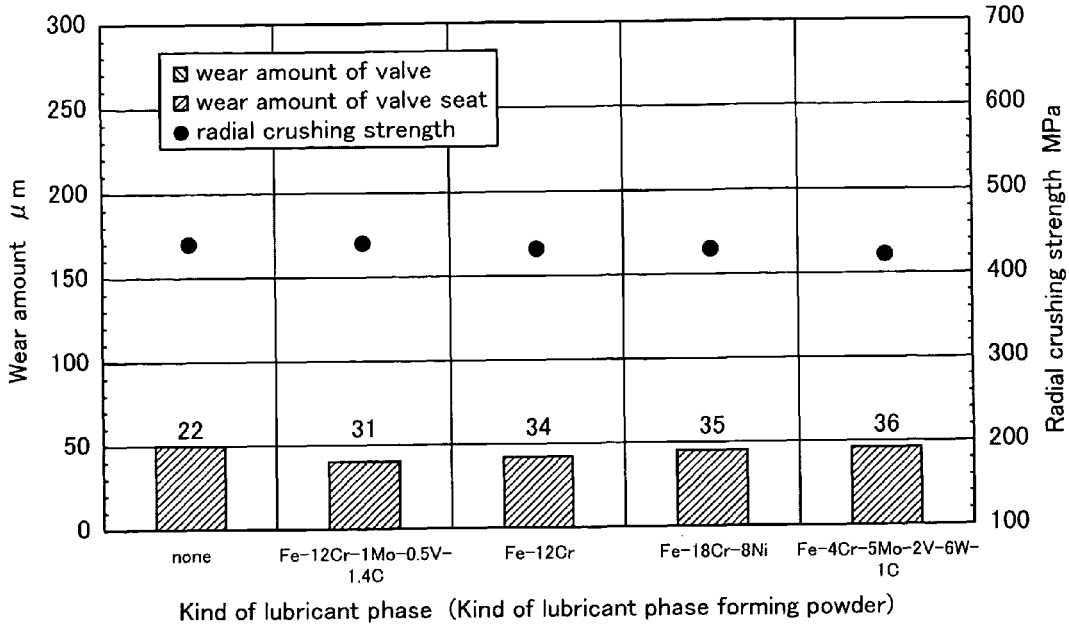
FIG. 15 is a graph showing the relationship of kind of lubricant phase forming powder and wear amount in the embodiments according to another aspect of the present invention.

The relationship between the kind of the lubricant phase (the kind of the lubricant phase forming powder) and the wear amount was examined by comparing the samples 22, 31 and 34 to 36 shown in Tables 9 and 10. The examined results are shown in FIG. 15. As shown in FIG. 15, when the lubricant phase was composed of Fe—Cr based alloy, the wear resistance was improved more than the sample 22 to which the lubricant phase forming powder was added. Thus, it was confirmed that the lubricant phase can be formed by mixing the raw powder with the various Fe—Cr based alloy powders and the wear resistance can be improved.

What is claimed is:

1. A manufacturing method for a wear resistant sintered member, the method comprising:

compacting a raw powder containing a matrix forming powder and a hard phase forming powder into a green compact, the matrix forming powder containing 90 mass % or more of a fine powder having a maximum particle diameter of 46 μm, the matrix forming powder containing Fe as a main component, and an amount of the hard phase forming powder being 50 to 70 mass % with respect to the raw powder; and sintering the green compact, wherein the hard phase forming powder consists of: all by mass %, 20 to 60% of Mo; 3 to 12% of Cr; 1 to 12% of Si; and the balance of Co and inevitable impurities.

2. The manufacturing method for the wear resistant sintered member according to claim 1, wherein the hard phase forming powder forms a hard phase in which silicide is dispersed in an alloy phase by the sintering.

3. The manufacturing method for the wear resistant sintered member, according to claim 1, wherein the matrix forming powder is a ferrous alloy powder containing 11 to 35 mass % of Cr.

4. The manufacturing method for the wear resistant sintered member, according to claim 3, wherein the ferrous alloy powder further contains 3.5 to 22 mass % of Ni.

5. The manufacturing method for the wear resistant sintered member, according to claim 3, wherein the matrix forming powder further contains at least one selected from a group consisting of all by mass %, 0.3 to 7% of Mo; 1 to 4% of Cu; 0.1 to 5% of Al; 0.3% or less of N; 5.5 to 10% of Mn; 0.15 to 5% of Si; 0.45 or less of Nb; 0.2% or less of P; 0.15% or less of S; and 0.15% or less of Se.

6. The manufacturing method for the wear resistant sintered member according to claim 1, wherein the amount of the hard phase forming powder being 60 to 70 mass %, with respect to the raw powder.

7. A manufacturing method for a sintered valve seat, the method comprising:

preparing a matrix forming powder having the maximum particle diameter of 74 μm, a hard phase forming powder having the maximum particle diameter of 150 μm and consisting of 20 to 60 mass % of Mo, 3 to 12 mass % of Cr, 1 to 5 mass % of Si, and the balance of Co and inevitable impurities, and a graphite powder;

mixing 50 to 70 mass % of the hard phase forming powder, 0.8 to 2.0 mass % of the graphite powder, and the balance of the matrix forming powder to prepare a raw powder;

compacting the raw powder into a green compact; and sintering the green compact, wherein the matrix forming powder contains Fe as a main component, and wherein the matrix forming powder contains 90 mass % or more of a fine powder having a maximum particle diameter of 46 μm, and the balance of the matrix forming powder has a maximum particle diameter of 74 μm.

8. The manufacturing method for the sintered valve seat according to claim 7, wherein the matrix forming powder is at least one selected from the group consisting of the following (A) to (E):

(A) steel powder comprising 1.5 to 5 mass % of Mo, and the balance of Fe and inevitable impurities;

(B) steel powder comprising 2 to 4 mass % of Cr, 0.2 to 0.4 mass % of Mo, 0.2 to 0.4 mass % of V, and the balance of Fe and inevitable impurities;

(C) steel powder comprising 5.5 to 7.5 mass % of Co, 0.5 to 3 mass % of Mo, 0.1 to 3 mass % of Ni, and the balance of Fe and inevitable impurities;

(D) steel powder comprising 0.4 to 4 mass % of Mo, 0.6 to 5 mass % of Ni, 0.5 to 5 mass % of Cu, 0.05 to 2 mass % of Cr, 0.05 to 0.6 mass % of V, and the balance of Fe and inevitable impurities; and (E) partially diffusion bonding alloy powder comprising 1 to 10 mass % of Ni, 1 to 3 mass % of Cu, 0.4 to 1.0 mass % of Mo, and the balance of Fe and inevitable impurities.

9. The manufacturing method for the sintered valve seat according to claim 8, wherein the raw powder further contains 5 mass % or less of a nickel powder.

10. The manufacturing method for the sintered valve seat according to claim 8, wherein the raw powder further contains 5 mass % or less of a copper powder.

11. The manufacturing method for the sintered valve seat according to claim 7, wherein at least one sulfide powder selected from the group consisting of the following (F) to (I) is added to the raw powder such that amount of S in the raw powder is 0.04 to 5 mass %:

(F) molybdenum disulfide powder;

(G) tungsten disulfide powder;

(H) iron sulfide powder; and (I) copper sulfide powder.

12. The manufacturing method for the sintered valve seat according to claim 11, wherein at least one chromium containing steel powder having the maximum particle diameter of 150 μm selected from the group consisting of the following (J) to (N) is added as a lubricating phase forming powder to the raw powder at an amount of 5 to 20 mass %:

(J) chromium containing steel powder comprising 4 to 25 mass % of Cr, and the balance of Fe and inevitable impurities;

(K) chromium containing steel powder comprising 4 to 25 mass % of Cr, 3.5 to 22 mass % of Ni, and the balance of Fe and inevitable impurities;

(L) chromium containing steel powder comprising 4 to 25 mass % of Cr, 3.5 to 22 mass % of Ni, 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se, and the balance of Fe and inevitable impurities;

(M) chromium containing steel powder comprising 7.5 to 25 mass % of Cr, 0.3 to 3.0 mass % of Mo, 0.25 to 2.4 mass % of C, 0.2 to 2.2 mass % of V, 1.0 to 5.0 mass % of W, and the balance of Fe and inevitable impurities; and (N) chromium containing steel powder comprising 4 to 6 mass % of Cr, 4 to 8 mass % of Mo, 0.5 to 3 mass % of V, 4 to 8 mass % of W, 0.6 to 1.2 mass % of C, and the balance of Fe and inevitable impurities.

13. The manufacturing method for the sintered valve seat according to claim 7, wherein the raw powder further contains 2 mass % or less of at least one powder selected from the group consisting of manganese sulfide powder, calcium fluoride powder, boron nitride powder, magnesium meta-silicate mineral powder, bismuth powder, and bismuth oxide powder.

14. The manufacturing method for the sintered valve seat according to claim 7, wherein lead, lead alloy, copper, copper alloy or acrylic resin is infiltrated or impregnated in pores of the sintered compact.

15. The manufacturing method for the sintered valve seat according to claim 7, wherein the amount of the hard phase forming powder being 60 to 70 mass %, with respect to the raw powder.

* * * * *